US009663930B2

(12) United States Patent
Ball

(10) Patent No.: US 9,663,930 B2
(45) **Date of Patent: *May 30, 2017**

(54) OVERFLOW ASSEMBLY FOR BATHTUBS AND THE LIKE

(71) Applicant: WCM Industries, Inc., Colorado Springs, CO (US)

(72) Inventor: William T. Ball, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 79 days.

This patent is subject to a terminal disclaimer.

(21) Appl. No.: 14/710,351

(22) Filed: May 12, 2015

(65) Prior Publication Data

US 2015/0275487 A1 Oct. 1, 2015

Related U.S. Application Data

(63) Continuation of application No. 13/894,626, filed on May 15, 2013, now Pat. No. 9,200,436, which is a (Continued)

(51) Int. Cl.

| | |
|---|---|
| ***E03D 1/22*** | (2006.01) |
| ***E03C 1/232*** | (2006.01) |
| ***E03C 1/24*** | (2006.01) |

(52) U.S. Cl.

CPC ..... *E03C 1/232* (2013.01); *E03C 1/24* (2013.01); *E03C 2001/2413* (2013.01)

(58) Field of Classification Search

CPC ..... E03C 1/24

(Continued)

(56) References Cited

U.S. PATENT DOCUMENTS

| | | | |
|---|---|---|---|
| 427,478 | A | 5/1890 | McEvoy |
| 843,968 | A | 2/1907 | Sharp, Jr. |

(Continued)

FOREIGN PATENT DOCUMENTS

| | | |
|---|---|---|
| CH | 346187 | 4/1960 |
| DE | 1163257 | 2/1964 |

(Continued)

OTHER PUBLICATIONS

"AB&A Catalog," American Brass & Aluminum Foundry, Inc., Sep. 1, 1995, 28 pages.

(Continued)

*Primary Examiner* — Lori Baker
(74) *Attorney, Agent, or Firm* — Sheridan Ross P.C.

(57) ABSTRACT

An overflow system in the bathtub has an overflow port and has a drain pipe in connection with the overflow port. A threaded flange has a stub shoulder on one end which is fitted into a circular sleeve on the overflow port. The threaded flange has exterior threads on its outer surface and a thin diaphragm secured to the end thereof opposite to the stub shoulder. A large internally threaded nut is threadably mounted on the outer end of the threaded flange. A decorative cap is frictionally snapped into engagement with protrusions on the outer surface of the nut. The cap can be removed when needed to permit the plumber to gain access to the diaphragm to cut it open for fluid flow after the system has been tested for leaks, or put in place after the cut takes place.

3 Claims, 18 Drawing Sheets

Related U.S. Application Data continuation of application No. 13/461,422, filed on May 1, 2012, now Pat. No. 8,505,132, which is a continuation of application No. 12/057,660, filed on Mar. 28, 2008, now Pat. No. 8,166,584, which is a continuation-in-part of application No. 10/674,862, filed on Sep. 30, 2003, now abandoned, which is a continuation-in-part of application No. 10/222,062, filed on Aug. 16, 2002, now Pat. No. 6,637,050, and a continuation-in-part of application No. 10/229,533, filed on Aug. 28, 2002, now Pat. No. 6,675,406, which is a continuation of application No. 09/593,724, filed on Jun. 13, 2000, now abandoned, said application No. 12/057,660 is a continuation-in-part of application No. 10/732,726, filed on Dec. 10, 2003, now Pat. No. 8,300,220, which is a continuation-in-part of application No. 10/229,533, which is a continuation of application No. 09/593,724, and a continuation-in-part of application No. 09/954,420, filed on Sep. 17, 2001, now Pat. No. 6,691,411, application No. 14/710,351, which is a continuation-in-part of application No. 13/234,030, filed on Sep. 15, 2011, now Pat. No. 8,321,970, which is a continuation of application No. 11/931,681, filed on Oct. 31, 2007, now Pat. No. 8,028,357, which is a continuation-in-part of application No. 10/674,862, which is a continuation-in-part of application No. 10/222,062, and a continuation-in-part of application No. 10/229,533, which is a continuation of application No. 09/593,724, said application No. 11/931,681 is a continuation-in-part of application No. 10/732,726, filed on Dec. 10, 2003, now Pat. No. 8,302,220, which is a continuation-in-part of application No. 09/954,420, said application No. 11/931,681 is a continuation-in-part of application No. 10/721,694, filed on Nov. 25, 2003, now abandoned, which is a continuation-in-part of application No. 10/247,247, filed on Sep. 19, 2002, now abandoned, said application No. 11/931,681 is a continuation-in-part of application No. 10/971,895, filed on Oct. 22, 2004, now abandoned, and a continuation-in-part of application No. 11/161,933, filed on Aug. 23, 2005, now Pat. No. 7,503,083.

(58) Field of Classification Search
USPC ..... 4/679–694
See application file for complete search history.

(56) References Cited

U.S. PATENT DOCUMENTS

| | | | |
|---|---|---|---|
| 880,939 | A | 3/1908 | Virgo |
| 1,213,466 | A | 1/1917 | Delanoy et al. |
| 1,330,909 | A | 2/1920 | Sharp, Jr. |
| 1,518,599 | A | 12/1924 | Murray |
| 1,573,820 | A | 2/1926 | Gade |
| 1,645,027 | A | 10/1927 | Scott |
| 1,669,473 | A | 5/1928 | Kelso |
| 1,788,083 | A | 1/1931 | Church |
| 1,925,008 | A | 8/1933 | Schacht |
| 1,977,177 | A | 10/1934 | De Flores |
| 2,044,253 | A | 6/1936 | Morris |
| 2,062,145 | A | 11/1936 | Pickop |
| 2,223,365 | A | 12/1940 | Groeniger |
| 2,374,815 | A | 5/1945 | Haas, Jr. |
| 2,444,340 | A | 6/1948 | Donahue |
| 2,832,081 | A | 4/1958 | Young |
| 2,915,903 | A | 12/1959 | Digby et al. |
| 2,993,655 | A | 7/1961 | O'Brien |
| 3,121,879 | A | 2/1964 | Young |
| 3,493,978 | A | 2/1970 | Hindman et al. |
| 3,742,525 | A | 7/1973 | Oropallo |
| 3,937,497 | A | 2/1976 | Studer |
| D248,133 | S | 6/1978 | Shames et al. |
| 4,092,745 | A | 6/1978 | Oropallo |
| 4,123,810 | A | 11/1978 | Oropallo |
| 4,135,258 | A | 1/1979 | Braga et al. |
| 4,146,939 | A | 4/1979 | Izzi |
| 4,233,697 | A | 11/1980 | Cornwall |
| 4,307,901 | A | 12/1981 | Orberg et al. |
| 4,352,213 | A | 10/1982 | Watts |
| 4,359,790 | A | 11/1982 | Chalberg |
| 4,371,991 | A | 2/1983 | Schrott |
| 4,387,914 | A | 6/1983 | Paulson et al. |
| 4,413,384 | A | 11/1983 | Lassche |
| 4,553,625 | A | 11/1985 | Tsuge et al. |
| 4,683,597 | A | 8/1987 | Taylor et al. |
| 4,706,482 | A | 11/1987 | Barber |
| 4,730,855 | A | 3/1988 | Pelletier |
| D296,816 | S | 7/1988 | Budzinski et al. |
| 4,813,745 | A | 3/1989 | Woody |
| 4,825,477 | A | 5/1989 | Aranda |
| 4,865,353 | A | 9/1989 | Osborne |
| 4,890,967 | A | 1/1990 | Rosenbaum |
| 4,920,582 | A | 5/1990 | Alker |
| 4,953,235 | A | 9/1990 | Cornwall |
| 5,025,509 | A | 6/1991 | Holt et al. |
| 5,123,123 | A | 6/1992 | Hart et al. |
| 5,257,648 | A | 11/1993 | Oropallo |
| 5,265,281 | A | 11/1993 | McAlpine |
| 5,267,474 | A | 12/1993 | Ten Hoven |
| 5,273,077 | A | 12/1993 | Oropallo |
| 5,295,760 | A | 3/1994 | Rowe |
| 5,350,266 | A | 9/1994 | Espey et al. |
| 5,351,996 | A | 10/1994 | Martin |
| 5,369,815 | A | 12/1994 | Martin |
| 5,377,361 | A | 1/1995 | Piskula |
| 5,417,460 | A | 5/1995 | Lunder |
| 5,507,501 | A | 4/1996 | Palmer |
| 5,590,916 | A | 1/1997 | Liu |
| 5,692,248 | A | 12/1997 | Ball |
| 5,745,931 | A | 5/1998 | Ball |
| 5,786,054 | A | 7/1998 | Platusich et al. |
| 5,799,986 | A | 9/1998 | Corbett et al. |
| 5,815,895 | A | 10/1998 | Carlson et al. |
| 5,890,241 | A | 4/1999 | Ball |
| 5,957,514 | A | 9/1999 | Brookshire |
| 5,971,438 | A | 10/1999 | Johnson |
| 6,058,526 | A | 5/2000 | Parisi et al. |
| 6,066,119 | A | 5/2000 | Ball |
| 6,073,278 | A | 6/2000 | Ball |
| 6,085,363 | A | 7/2000 | Huber |
| 6,088,843 | A | 7/2000 | Francisco |
| 6,126,233 | A | 10/2000 | Gaetano et al. |
| 6,145,136 | A | 11/2000 | Parisi et al. |
| 6,192,531 | B1 | 2/2001 | Fritz et al. |
| 6,193,879 | B1 | 2/2001 | Bowman |
| 6,216,288 | B1 | 4/2001 | Bernau |
| 6,263,518 | B1 | 7/2001 | Magtanong |
| 6,272,699 | B1 | 8/2001 | Peterson |
| 6,289,532 | B1 | 9/2001 | Fritz et al. |
| 6,295,664 | B2 | 10/2001 | Fritz et al. |
| 6,338,168 | B1 | 1/2002 | Valentine |
| 6,362,734 | B1 | 3/2002 | McQuade et al. |
| 6,448,907 | B1 | 9/2002 | Naclerio |
| 6,484,331 | B2 | 11/2002 | Minnick |
| 6,508,490 | B1 | 1/2003 | Hoffman |
| 6,530,722 | B1 | 3/2003 | Shaw et al. |
| 6,546,573 | B1 | 4/2003 | Ball |
| 6,606,753 | B2 | 8/2003 | Minnick |
| 6,618,875 | B1 | 9/2003 | Oropallo et al. |
| 6,622,317 | B1 | 9/2003 | Oropallo et al. |
| 6,637,050 | B1 | 10/2003 | Ball |
| 6,640,358 | B2 | 11/2003 | Ball |
| 6,675,406 | B2 | 1/2004 | Ball |
| 6,681,420 | B1 | 1/2004 | Ball |
| 6,687,926 | B1 | 2/2004 | Bayley |
| 6,691,411 | B2 | 2/2004 | Ball |
| 6,696,943 | B1 | 2/2004 | Elrod et al. |

(56) References Cited

U.S. PATENT DOCUMENTS

| | | | |
|---|---|---|---|
| 6,812,844 | B1 | 11/2004 | Burgess |
| 6,836,911 | B2 | 1/2005 | Minnick |
| 6,953,049 | B2 | 10/2005 | Kowalke |
| D517,666 | S | 3/2006 | Wilk, Jr. et al. |
| 7,017,199 | B2 | 3/2006 | Oropallo et al. |
| D523,123 | S | 6/2006 | Wilk, Jr. et al. |
| 7,127,752 | B2 | 10/2006 | Ball |
| 7,237,280 | B1 | 7/2007 | Holden et al. |
| 7,300,074 | B1 | 11/2007 | Paulson |
| D586,433 | S | 2/2009 | Price et al. |
| 7,503,083 | B2 | 3/2009 | Ball |
| D627,863 | S | 11/2010 | Ball |
| D636,468 | S | 4/2011 | Ball |
| D637,696 | S | 5/2011 | Ball |
| 8,028,357 | B2 | 10/2011 | Ball |
| 8,166,584 | B2 | 5/2012 | Ball |
| D665,062 | S | 8/2012 | Ball |
| 8,302,220 | B2 | 11/2012 | Ball |
| 8,321,970 | B2 | 12/2012 | Ball |
| 8,505,132 | B2 | 8/2013 | Ball |
| 2002/0032926 | A1 | 3/2002 | Lewis |
| 2003/0151281 | A1 | 8/2003 | Williams |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2006/0085907 | A1 | 4/2006 | Ball |
| 2007/0007763 | A1 | 1/2007 | Deaton |
| 2008/0148477 | A1 | 6/2008 | Shafik |
| 2008/0155745 | A1 | 7/2008 | Burr |
| 2008/0196161 | A1 | 8/2008 | Ball |
| 2009/0261579 | A1 | 10/2009 | Spears |
| 2012/0005824 | A1 | 1/2012 | Ball |
| 2013/0283523 | A1 | 10/2013 | Ball |

FOREIGN PATENT DOCUMENTS

| | | |
|---|---|---|
| DE | 3603877 | 1/1997 |
| EP | 0845559 | 6/1998 |
| FR | 744099 | 4/1933 |
| JP | H02-144074 | 6/1990 |

OTHER PUBLICATIONS

Definition of the term "diaphragm" found at: http://www.thefreedictionary.com/diaphragm, cited in Aug. 7, 2012 OA for U.S. Appl. No. 13/234,030.

"Geberit Installation Manual," Geberit, Dec. 12, 2012, 10 pages.

"New WATCO Eliminator Bath Waste", WATCO, as early as Aug. 8, 2001, pp. 1-2.

U.S. Appl. No. 09/593,724, filed Jun. 13, 2000, Ball.

"PVC Scheduling 80 Fittings," Spears Manufacturing Co., May 28, 1996, 2 pages.

"Tubular Plastic-Innovator® 590", Woodford Manufacturing Company, first sold Aug. 16, 2001, pp. 1-2.

"WCM Industries-Freezeless Faucets, Yard Hydrants and Bath Wastes", as early as Aug. 2000, available at http://www.woodfordmfg.com/, printed on Sep. 15, 2005, p. 1.

"Why choose a Geberit Cable Driven Bath Waste Overflow?" Geberit, date unknown, 2 pages.

Complaint (with Exhibits A-J), *WCM Industries, Inc.* v. *IPS Corporation, et al.*, U.S. District Court, Western District of Tennessee, Western Division, Case No. 2:13-cv-02019-JPM-tmp, filed Jan. 9, 2013, 117 pages.

Answer and Counterclaim, *WCM Industries, Inc.* v. *IPS Corporation, et al.*, U.S. District Court, Western District of Tennessee, Western Division, Case No. 2:13-cv-02019-JPM-tmp, filed Feb. 19, 2013, 16 pages.

Reply to Defendant'S Counterclaims, *WCM Industries, Inc.* v. *IPS Corporation, et al.*, U.S. District Court, Western District of Tennessee, Western Division, Case No. 2:13-cv-02019-JPM-tmp, filed Mar. 12, 2013, 4 pages.

Declaration of Wolpert and Exhibits A-D, *WCM Industries, Inc.* v. *IPS Corporation, et al.*, U.S. District Court, Western District of Tennessee, Western Division, Case No. 2:13-cv-02019-JPM-dkv, Oct. 22, 2014, 21 pages.

Plaintiff IPS's Final Invalidity Contentions, *IPS Corporation* v. *WCM Industries, Inc.*, United States District Court for the Western District of Tennessee, Case No. 2:12-cv-02694-JPM-dkv, dated Feb. 23, 2015, 17 pages.

Plaintiff IPS's Final Invalidity Contentions (Exhibit A), *IPS Corporation* v. *WCM Industries, Inc.*, United States District Court for the Western District of Tennessee, Case No. 2:12-cv-02694-JPM-dkv, dated Feb. 23, 2015, 3 pages.

Plaintiff IPS's Final Invalidity Contentions (Exhibit B-1), *IPS Corporation* v. *WCM Industries, Inc.*, United States District Court for the Western District of Tennessee, Case No. 2:12-cv-02694-JPM-dkv, dated Feb. 23, 2015, 951 pages.

Plaintiff IPS's Final Invalidity Contentions (Exhibit B-2), *IPS Corporation* v. *WCM Industries, Inc.*, United States District Court for the Western District of Tennessee, Case No. 2:12-cv-02694-JPM-dkv, dated Feb. 23, 2015, 1003 pages.

Plaintiff IPS's Final Invalidity Contentions (Exhibit B-3), *IPS Corporation* v. *WCM Industries, Inc.*, United States District Court for the Western District of Tennessee, Case No. 2:12-cv-02694-JPM-dkv, dated Feb. 23, 2015, 351 pages.

Plaintiff IPS's Final Invalidity Contentions (Exhibit B-7), *IPS Corporation* v. *WCM Industries, Inc.*, United States District Court for the Western District of Tennessee, Case No. 2:12-cv-02694-JPM-dkv, dated Feb. 23, 2015, 531 pages.

Plaintiff IPS's Final Invalidity Contentions (Exhibit B-8), *IPS Corporation* v. *WCM Industries, Inc.*, United States District Court for the Western District of Tennessee, Case No. 2:12-cv-02694-JPM-dkv, dated Feb. 23, 2015, 1219 pages.

Official Action for U.S. Appl. No. 13/234,030, mailed Aug. 7, 2012 13 pages.

Official Action for U.S. Appl. No. 10/732,726, mailed Mar. 28, 2005 (Restriction Requirement).

Official Action for U.S. Appl. No. 10/732,726, mailed May 23, 2005.

Official Action for U.S. Appl. No. 10/732,726, mailed Oct. 24, 2005.

Official Action for U.S. Appl. No. 10/732,726, mailed May 19, 2006.

Official Action for U.S. Appl. No. 10/732,726, mailed Jan. 30, 2008.

Official Action for U.S. Appl. No. 10/732,726, mailed Jun. 2, 2008.

Official Action for U.S. Appl. No. 10/732,726, mailed Aug. 20, 2008.

Official Action for U.S. Appl. No. 10/732,726, mailed Nov. 17, 2008.

Official Action for U.S. Appl. No. 10/732,726, mailed Dec. 9, 2008.

Official Action for U.S. Appl. No. 10/732,726, mailed May 1, 2008.

Official Action for U.S. Appl. No. 10/732,726, mailed Sep. 4, 2009.

Official Action for U.S. Appl. No. 10/732,726, mailed Apr. 15, 2010.

Notice of Allowance for U.S. Appl. No. 10/732,726, mailed Sep. 20, 2012, 5 pages.

Official Action for U.S. Appl. No. 10/674,862, mailed Mar. 28, 2005.

Official Action for U.S. Appl. No. 10/674,862, mailed Aug. 18, 2004.

Notice of Allowance for U.S. Appl. No. 10/674,862, mailed Aug. 24, 2006.

Official Action for U.S. Appl. No. 10/674,862, mailed Oct. 6, 2005.

Official Action for U.S. Appl. No. 10/674,862, mailed Sep. 20, 2005.

Official Communication for U.S. Appl. No. 10/674,862, mailed May 23, 2008.

Examiners Answer for U.S. Appl. No. 10/674,862, mailed May 15, 2008.

Official Action for U.S. Appl. No. 10/674,862, mailed May 1, 2007.

Official Action for U.S. Appl. No. 10/674,862, mailed Dec. 21, 2006.

(56) References Cited

OTHER PUBLICATIONS

Notice of Allowance for U.S. Appl. No. 10/738,772, mailed Aug. 1, 2006.
Official Action for U.S. Appl. No. 10/738,772, mailed May 11, 2006.
Official Action for U.S. Appl. No. 10/738,772, mailed Mar. 27, 2006.
Official Action for U.S. Appl. No. 10/738,772, mailed Aug. 2, 2005.
Official Action for U.S. Appl. No. 10/738,772, mailed May 13, 2005.
Official Action for U.S. Appl. No. 10/738,772, mailed Mar. 11, 2005.
Official Action for U.S. Appl. No. 10/738,772, mailed Sep. 17, 2004.
Official Action for U.S. Appl. No. 10/738,765, mailed May 22, 2007.
Official Action for U.S. Appl. No. 10/738,765, mailed Jan. 13, 2006.
Official Action for U.S. Appl. No. 10/738,765, mailed Jun. 6, 2005.
Official Action for U.S. Appl. No. 10/738,765, mailed Apr. 13, 2006.
Notice of Allowability for Design U.S. Appl. No. 29/362,288, mailed Oct. 7, 2010.
Official Action for U.S. Appl. No. 10/732,726, mailed Oct. 25, 2010.
Official Action for U.S. Appl. No. 10/732,726, mailed May 9, 2011 9 pages.
Official Action for U.S. Appl. No. 12/057,660, mailed Nov. 3, 2011 9 pages.
Official Action for U.S. Appl. No. 10/732,726, mailed Nov. 16, 2011 9 pages.
Notice of Allowance for U.S. Appl. No. 12/057,660, mailed Mar. 7, 2012 5 pages.
Official Action for U.S. Appl. No. 29/378,602, mailed Mar. 9, 2012 6 pages Restriction Requirement.
Official Action for U.S. Appl. No. 29/378,602, mailed Mar. 27, 2012 5 pages.
Notice of Allowance for U.S. Appl. No. 29/378,602, mailed Jun. 21, 2012 7 pages.
Official Action for U.S. Appl. No. 13/461,422 mailed Dec. 27, 2012 9 pages.
Notice of Allowance for U.S. Appl. No. 13/461,422 mailed Apr. 18, 2013, 6 pages.
Official Action for U.S. Appl. No. 13/894,626, mailed Jul. 16, 2015 7 pages.
Notice of Allowance for U.S. Appl. No. 13/894,626, mailed Aug. 10, 2015 5 pages.

OVERFLOW ASSEMBLY FOR BATHTUBS AND THE LIKE

CROSS REFERENCE TO RELATED APPLICATIONS

This application is a continuation of U.S. patent application Ser. No. 13/894,626, filed May 15, 2013, which is a continuation of U.S. patent application Ser. No. 13/461,422, filed May 1, 2012, which is a continuation of U.S. patent application Ser. No. 12/057,660, now U.S. Pat. No. 8,166,584, filed Mar. 28, 2008, which is a continuation-in-part of U.S. patent application Ser. No. 10/674,862, filed Sep. 30, 2003, which is a continuation-in-part of U.S. patent application Ser. No. 10/222,062, now U.S. Pat. No. 6,637,050, filed Aug. 16, 2002, and a continuation-in-part of U.S. patent application Ser. No. 10/229,533, now U.S. Pat. No. 6,675,406, filed Aug. 28, 2002 , which is a continuation of U.S. patent application Ser. No. 09/593,724, filed Jun. 13, 2000. U.S. patent application Ser. No. 12/057,660 also being a continuation-in-part of U.S. patent application Ser. No. 10/732,726, now U.S. Pat. No. 8,302,220, filed Dec. 10, 2003, which is a continuation-in-part of U.S. patent application Ser. No. 10/229,533, now U.S. Pat. No. 6,675,406, filed Aug. 28, 2002, which is a continuation of U.S. patent application Ser. No. 09/593,724, filed Jun. 13, 2000, and a continuation-in-part of U.S. patent application Ser. No. 09/954,420, now U.S. Pat. No. 6,691,411, filed Sep. 17, 2001. The entire disclosures of the above-referenced patents and applications are incorporated by reference herein.

This application is also a continuation-in-part of U.S. patent application Ser. No. 13/234,030, now U.S. Pat. No. 8,321,970, filed Sep. 15, 2011, which is a continuation of U.S. patent application Ser. No. 11/931,681, now U.S. Pat. No. 8,028,357, filed Oct. 31, 2007, which is a continuation-in-part of U.S. patent application Ser. No. 10/674,862, filed Sep. 30, 2003, which is a continuation-in-part of U.S. patent application Ser. No. 10/222,062, now U.S. Pat. No. 6,637,050, filed Aug. 16, 2003, and a continuation-in-part of U.S. patent application Ser. No. 10/229,533, now U.S. Pat. No. 6,675,406, filed Aug. 28, 2002, which is a continuation of U.S. patent application Ser. No. 09/593,724, filed Jun. 13, 2000. U.S. patent application Ser. No. 11/931,681 also being a continuation of U.S. patent application Ser. No. 10/732,726, now U.S. Pat. No. 8,302,220, filed Dec. 10, 2003, which is a Continuation-In-Part of U.S. patent application Ser. No. 09/954,420, now U.S. Pat. No. 6,691,411, filed Sep. 17, 2001. U.S. patent application Ser. No. 11/931,681 also being a continuation-in-part of U.S. patent application Ser. No. 10/721,694, filed Nov. 25, 2003, which is a continuation-in-part of U.S. patent application Ser. No. 10/247,247, filed Sep. 19, 2002. U.S. patent application Ser. No. 11/931,681 also being a continuation-in-part of U.S. patent application Ser. No. 10/971,895, filed Oct. 22, 2004. U.S. patent application Ser. No. 11/931,681 also being a continuation-in-part of U.S. patent application Ser. No. 11/161,933, now U.S. Pat. No. 7,503,083, filed Aug. 23, 2005. The entire disclosures of which are incorporated by reference herein.

BACKGROUND OF THE INVENTION

In new building construction, plumbers prefer not to install finished closure valves in the bottom of bathtubs, or install finished decorative plate over an overflow outlet of the bathtub until the project is finished because these elements will be often damaged during construction. Further, the plumbing for all outlets needs to be checked for leaks which involves filling a vent for the drain until the water level in the plumbing rises above the bathtub so that the inspector can determine whether any of the plumbing leaks. The bottom drain of the bathtub is plugged and some sort of seal plate is used to block the outlet port during testing.

Existing overflow plates have a center opening. There are either two or four small screw holes in the plate adjacent the center opening wherein two of the holes are used to secure the plate to the plumbing fixture. In some cases, a fitting is used so that the screw hole is located directly in the middle of the access hole that becomes an obstacle during testing. The testing procedure usually involves placing a balloon through the large center opening into a drain pipe located in the wall. The pipe is sealed when the balloon is inflated.

A more recent version of an overflow assembly is shown in the U.S. Pat. No. 5,890,241 to Ball ("Ball"), which is incorporated by reference herein. Ball discloses a flexible diaphragm that is imposed over an overflow drain pipe. A cap is also provided that allows fluid to flow into the overflow pipe. The diaphragm seals the overflow pipe when the system is being tested for leaks. Following the test, the diaphragm is cut or slashed to open the overflow port to allow fluid flow. While this device serves the intended function, it is expensive to make and cumbersome to assemble.

It is, therefore, a principal object of the invention to provide a method and a means for an overflow assembly for bathtubs and the like that will safeguard the overflow system during construction, prepare the overflow system for testing, and facilitate the final installation of bathtub hardware.

A further object of the invention is to facilitate the testing procedure of the overflow system before final installation has taken place, and to permit the assembly of parts without the use of screws, screw holes, and the like.

A still further object of the invention is to provide an overflow fitting that allows a user to install the overflow fitting without using solvent cement.

In constructing a bathtub, both the waste water drain assembly and overflow outlet must be designed to allow easy installation and testing of the bathtub. The traditional method of installing a waste water drain assembly for a bathtub is well established, and generally, is considered a two-person job. Not only is the process somewhat cumbersome and difficult, requiring pieces to be held in place while assembled, but it also creates obstacles to field testing the drain assemblies for leaks where testing is required. Likewise, the traditional method requires the removal of a strainer body in order to replace finished materials.

After installation, the plumbers prefer not to put the finished closure valves in the bottom of tubs, or the finished decorative plate over the overflow outlet at the end of the tub until the project is finished. The plumbers prefer this because these elements will often be damaged as the construction project is brought to a close.

Piping for both of the outlets needs to be checked for leaks before the inspection process is completed. This test involves running water down a vent attached to the drain until the water reaches a level above the tub. The tester then determines whether any of the piping leaks. Thus, when the testing operation is to take place, a plug is put in the bottom drain of the tub and some sort of seal plate is placed at the end of the tub on the overflow outlet.

Existing overflow plates have a center opening therein. There are either two or four small screw holes in the plate adjacent to the center opening. These screw holes are used to hold the plate to the plumbing fixture. The testing procedure usually involves stuffing a balloon through the large center opening into the pipe in the wall. The pipe is sealed when the balloon is inflated. Further, existing seal plates normally have to be removed when the decorative plate is put on.

It is therefore, an object of the invention is to provide an easier method to install a drain assembly that can be accomplished by a single individual.

An additional object is to provide a method that accommodates ease of field testing, ease in replacing finished parts, and reduction in the amount of material that requires special finishing.

It is therefore, an object of the invention is to provide easier method to install a drain assembly that can be accomplished by a single individual.

An additional object is to provide a method that accommodates ease of field testing, ease in replacing finished parts, and reduction in the amount of material that requires special finishing.

The primary object of the invention is to provide a method of installing a drain assembly that can be accomplished by a single individual.

A further object of the invention is to provide a method of installing a drain assembly that is easy to install and allows for ease in field testing for leaks.

Another objective of the present invention is to provide a method of installing a drain assembly that eliminates the need for the removal of the strainer body in order to replace finished parts.

A still further object of the present invention is to provide a method that reduces the number of parts that require special finishing.

It is another object of this invention to provide an overflow fitting which will safeguard the overflow system during construction.

A further object of the invention is to provide an overflow fitting which will prepare the overflow system for testing.

A still further object of the invention is to provide an overflow fitting which allows a user to install the overflow fitting without using solvent cement.

These and other objects will be apparent to those skilled in the art.

SUMMARY OF THE INVENTION

An overflow system of a bathtub generally includes an overflow port that is associated with a drain pipe. The overflow port includes a threaded flange with a stub shoulder on one end that is fitted onto a circular sleeve. The threaded flange has threads on its outer surface and a thin diaphragm secured to the end thereof opposite the stub shoulder. A large sealing washer cooperates with the outside of the circular flange on the overflow port and extends partially over the threads of the flange. A large internally threaded nut is threadably mounted on the outer end of the threaded flange and compresses the sealing washer against a vertical flange on the overflow port to seal the connection between the threaded flange and the overflow port. A decorative cap is frictionally engaged onto protrusions located on the outer surfaces of the nut. The cap can be removed if needed to permit a plumber to gain access to the diaphragm to cut it open for fluid flow after the plumbing system has been tested for leaks, or put in place after the cut takes place.

A bathtub drainage and overflow system assembly is a combination of a one-piece overflow pipe and a waste water drain assembly connected by a T-shaped elbow. A one-piece overflow fitting is provided for a bathtub having a one piece overflow pipe. The one piece overflow pipe has an inverted L-shape having an elbow portion defining an upper end portion and a lower end portion. The upper end portion has an outer end defining an inlet adapted to fit through a bathtub overflow port. Threads are located on an outer surface of the upper end portion and surround the inlet. A lip extends radially outwardly from an outer surface of the overflow pipe between the elbow portion and the upper end portion to engage an outer surface of the bathtub end wall around the bathtub overflow port. A thin diaphragm is sealed to the outer end of the upper end portion to close the inlet to fluid flow.

The waste water drain has an L-shaped drain pipe having an upper end with an annular flange covered by a membrane, an inner end, and a threaded portion near the upper end, through a drain hole of a bathtub, such that the annular flange rests on a bottom wall of the bathtub. A lock washer can be slidably mounted over the inner end of the drain pipe to the threaded portion, and then can be threadably tightened against a lower surface of the bottom wall of the bathtub. The outer end of the L-shaped drain pipe is then connected to a T-shaped elbow to combine the drain and overflow systems.

DETAILED DESCRIPTION

Figure 1:
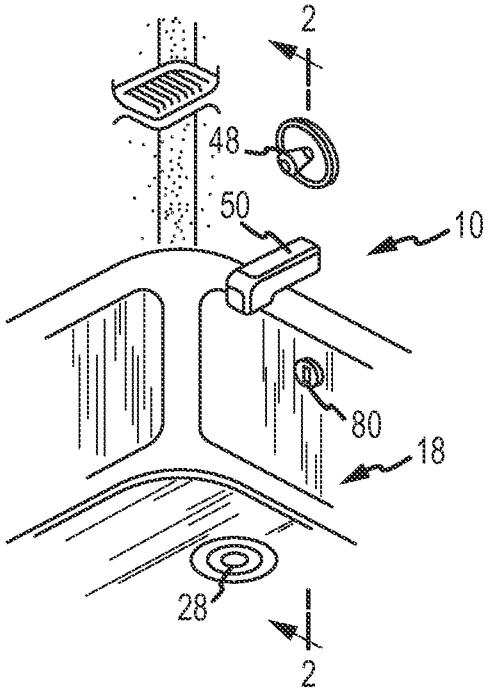
FIG. 1 is a partial perspective view of a conventional bathtub environment utilizing the invention of this application.
Figure 2:
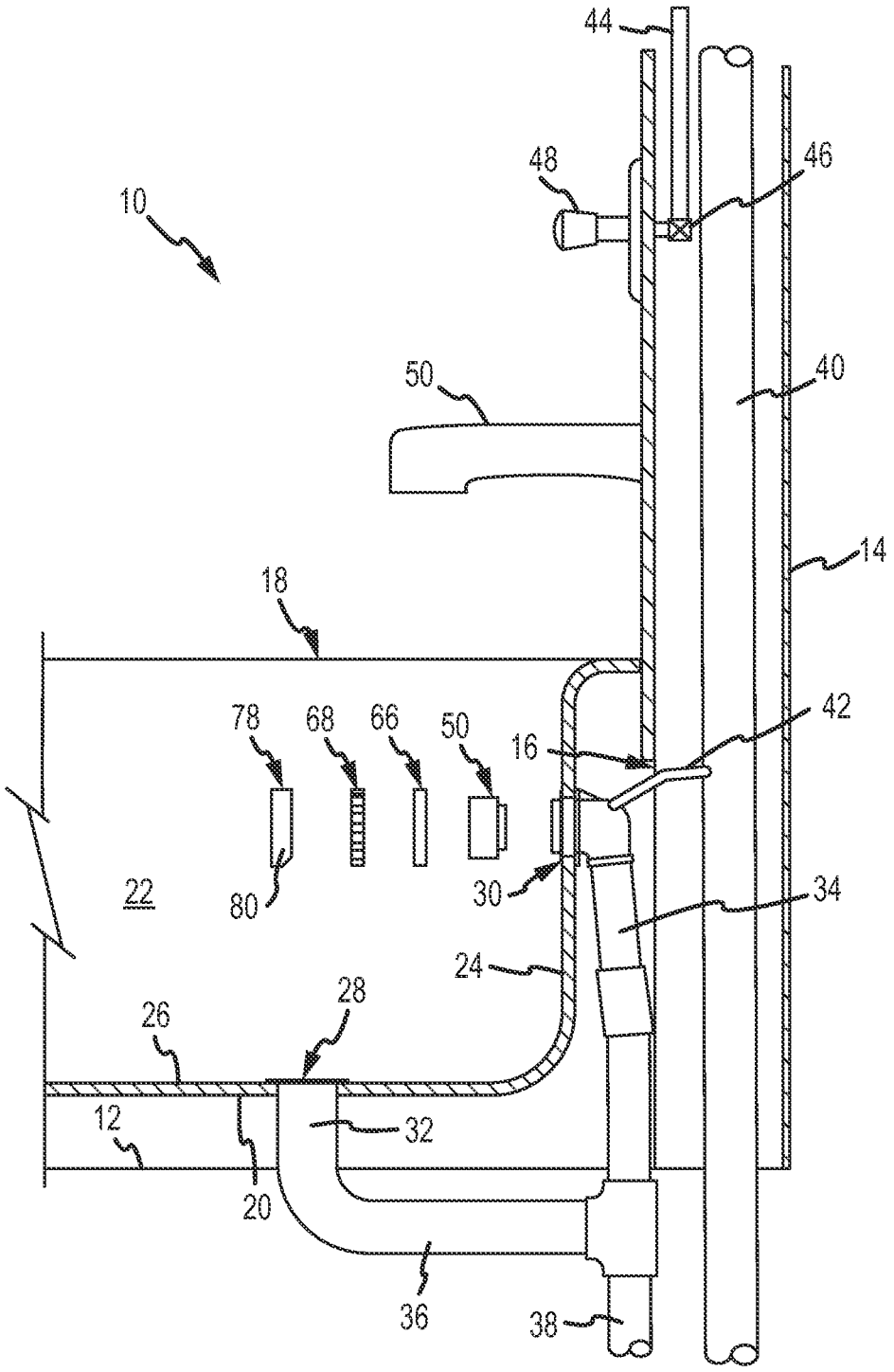
FIG. 2 is a section view taken on line 2-2 of FIG. 1.

With reference to FIGS. 1 and 2, a conventional bathroom structure 10 has a floor 12 and a hollow wall 14 with a wall opening 16 therein. A conventional bathtub ("tub") 18 has sidewalls that 22 extend upwardly from a base 20 as does an end wall 24. The end wall 24 extends upwardly from a bottom surface 26, perpendicular to the side walls 22.

A conventional drain port 28 is located in the bottom surface 26. A conventional overflow port 30 is located in the end wall 24 (FIG. 2). A vertical drain pipe 34 extends downwardly from drain port 28 and an overflow drain pipe 34 extends downwardly from overflow port 30. A horizontal pipe 36 connects pipes 32 and 34. A drain pipe 38 extends downwardly from the junction between pipes 34 and 36.

Figure 3:
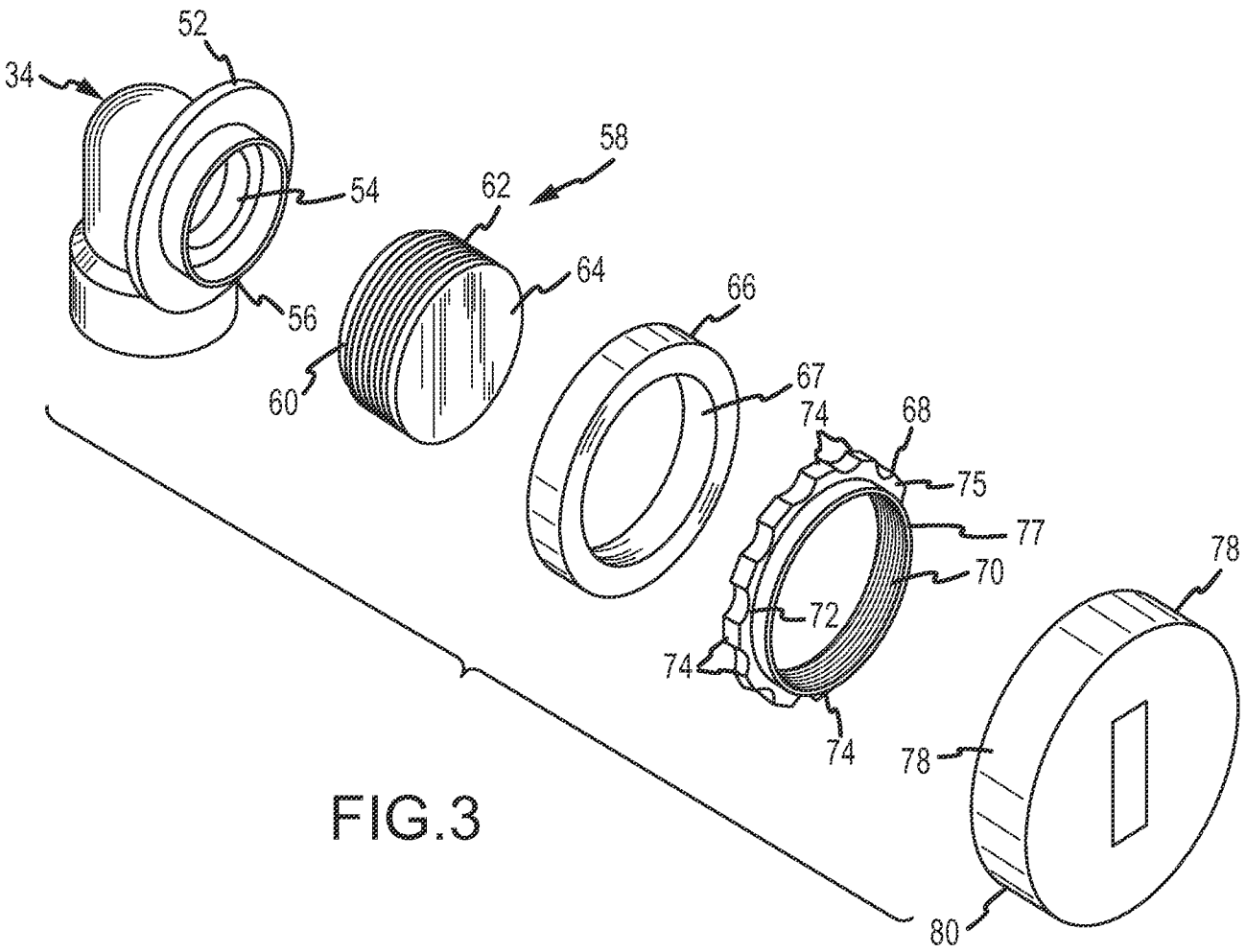
FIG. 3 is a perspective exploded view of an overflow assembly of one embodiment of the present invention.
Figure 4:
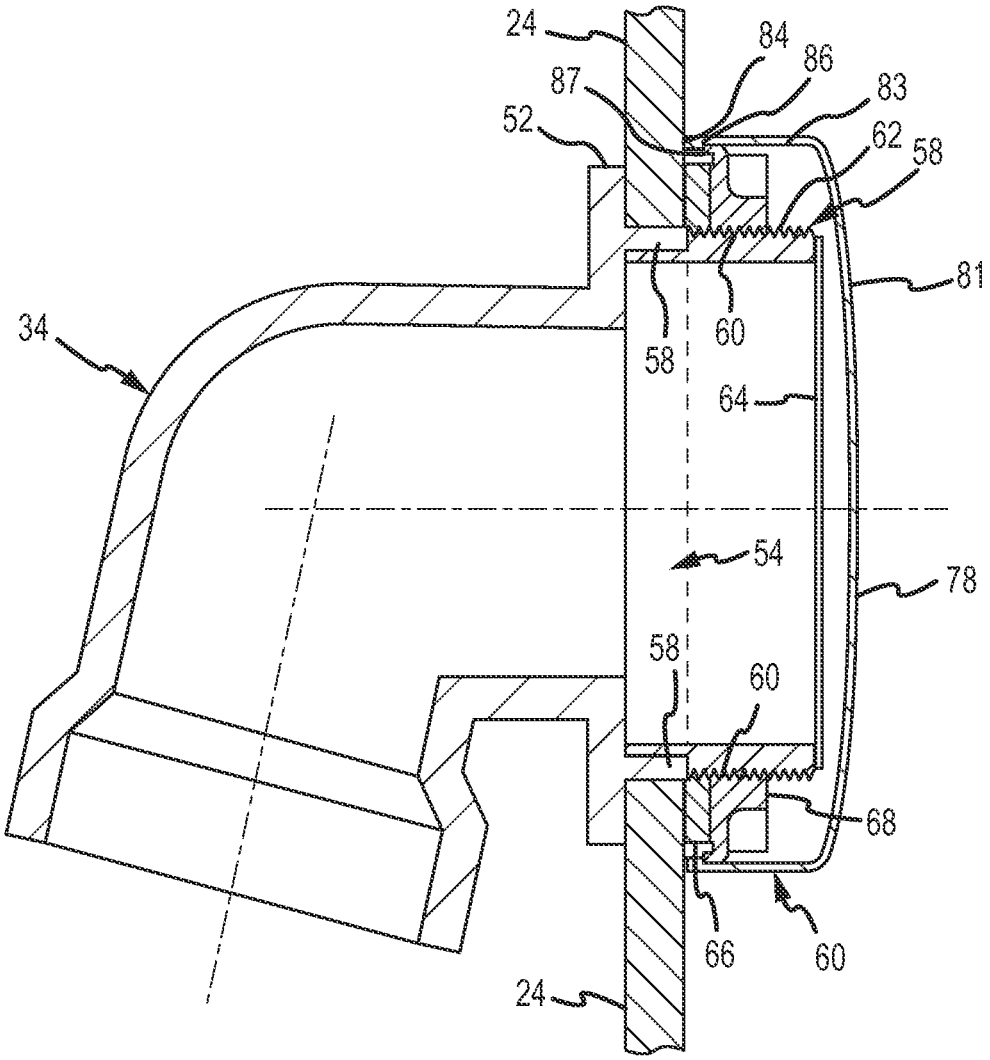
FIG. 4 is a cross sectional view of the assembled components of FIG. 3.

A conventional vent pipe 40 is located within the hollow wall 14. Pipe 42 interconnects the vent pipe 40 and the upper end of overflow drain pipe 34 (FIG. 2). Conventional water supply pipes 44 extend through hollow wall 14 and are connected to valve 46 which is interconnected to conventional control member 48 and faucet 50. FIGS. 3 and 4 show a radial flange 52 formed on the upper end of overflow drain pipe 34 and has a center opening or port 54. Water can flow through center opening 54 into overflow drain pipe 34. A sleeve 56 extends longitudinally outwardly from the perimeter of opening 54 forming a surface on its inner diameter.

A hollow cylindrical fitting 58 has a hollow cylindrical shoulder 60 on its inner end, a threaded outer surface 62, and a thin plastic diaphragm 64 sealed across its outer end. The shoulder 60 has an outer diameter that can be manually frictionally inserted within the surface of the inner diameter of sleeve 56 to create sufficient frictional force to resist opposing force applied by fluid pressure.

A pliable sealing ring or washer 66 has a center bore 67 which frictionally receives the exterior surface of fitting 58 to engage the radial flange 52 of port 54 to seal the connection between sleeve 56 and shoulder 60. The longitudinal thickness of washer 66 is less than the longitudinal thickness of fitting 58 so that some of the threaded surface 62 adjacent the diaphragm 64 is exposed when the washer 66 is mounted on fitting 58 in the position described above. A nut element 68 has a threaded center bore 70 which is compatible with the threaded outer surface 62 of fitting 58. As shown in FIG. 3, the nut element 68 may include a first portion 75 that has an outer periphery 72 and a second portion 77. The second portion 77 has a portion with an outer dimension that is less than an outermost dimension of the first portion 75. When the nut element 68 is tightened on threaded portion 62, the washer 66 is in tight engagement with flange 52 of port 54. The outer periphery 72 of nut element 68 has a series of radially extending lugs 74 which frictionally detachably engage the inner surface of flange 76 of cap 78. The cap 78 shown in FIG. 4 has an outer surface 81 with a wall 83 extending therefrom. When the cap 78 of FIG. 4 is detachably engaged onto the nut element 68, a protrusion 84 located near an end 85 of the wall 83 will engage in inner surface 87 of the nut element 68. The nut element 68 can be tightened on washer 66 either as positioned within cap 78, or before cap 78 and the nut element 68 are engaged. A notch 80 is located in flange 76 and is adapted to receive overflow water from tub 18 when required to do so. Notch 80 is normally in a 6 o'clock position on flange 76. FIG. 4 depicts the apparatus described above in an assembled state.

It is important to note that diaphragm 64 is of plastic material, as is fitting 58, and is preferably integrally formed with fitting 58 wherein diaphragm 64 and fitting 58 are one unitary component. The diaphragm 64 is a thin circular plate disk that is joined to fitting 58 by its outer peripheral edge engaging the outer peripheral edge of the fitting 58. If the two components are not molded as one unitary structure, the diaphragm 64 could be connected by fusing, hermetically sealing, or by otherwise rigidly attaching by its outer peripheral edge to the rearward outer peripheral edges of the fitting 58 by a suitable adhesive. No screws or the like are either required or desired.

Figure 6:
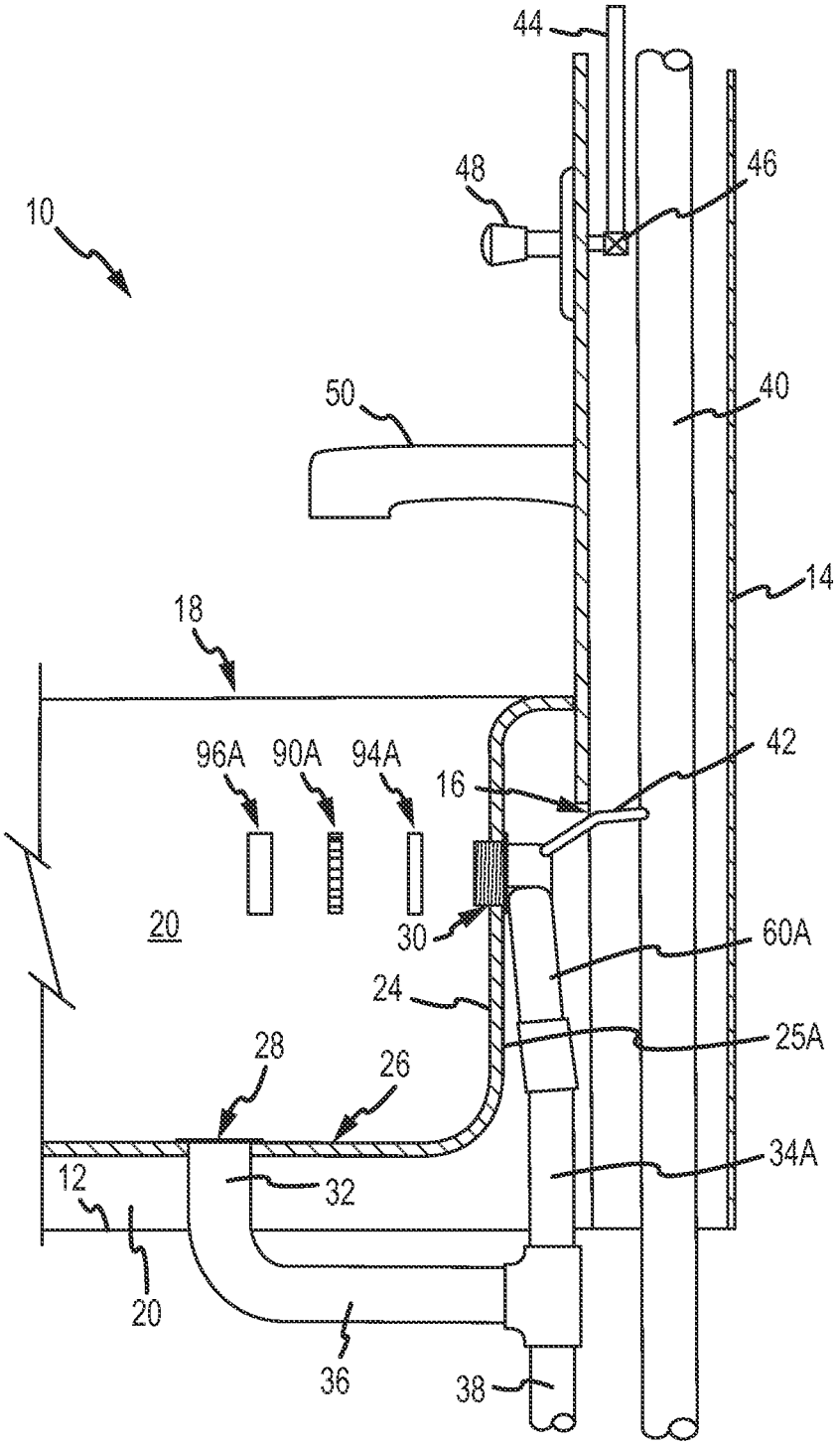
FIG. 6 is a sectional view of a conventional bathtub environment utilizing the device of another embodiment of the invention.

A second embodiment of the invention can be seen in FIG. 6. A one-piece overflow fitting 60A is shown attached to second vertical drain pipe 34A. A portion of the overflow fitting 60A passes through overflow port 30.

Figure 7:
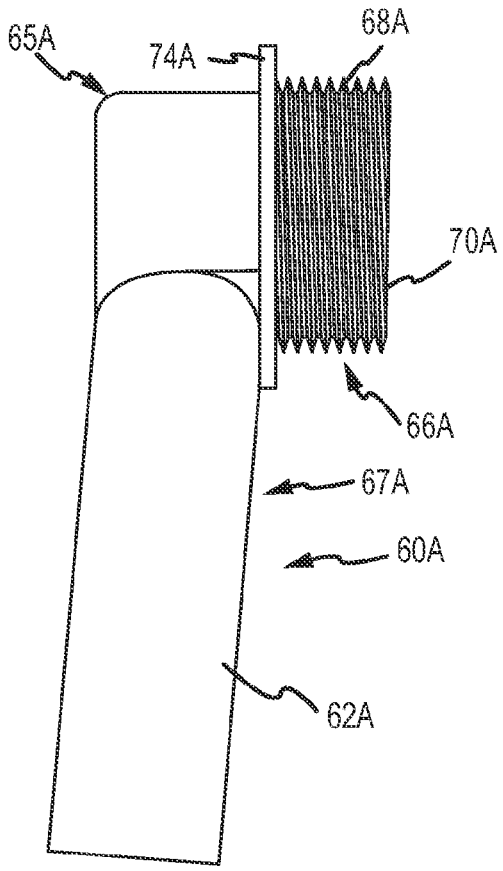
FIG. 7 is a side view of the device of the embodiment of the invention shown in FIG. 6.
Figure 8:
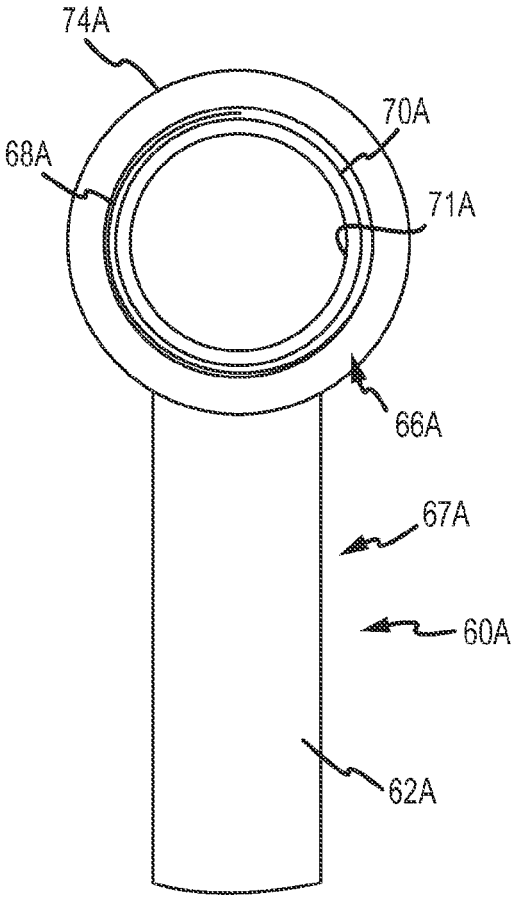
FIG. 8 is a front view of the device of the embodiment of the invention shown in FIG. 6.
Figure 9:
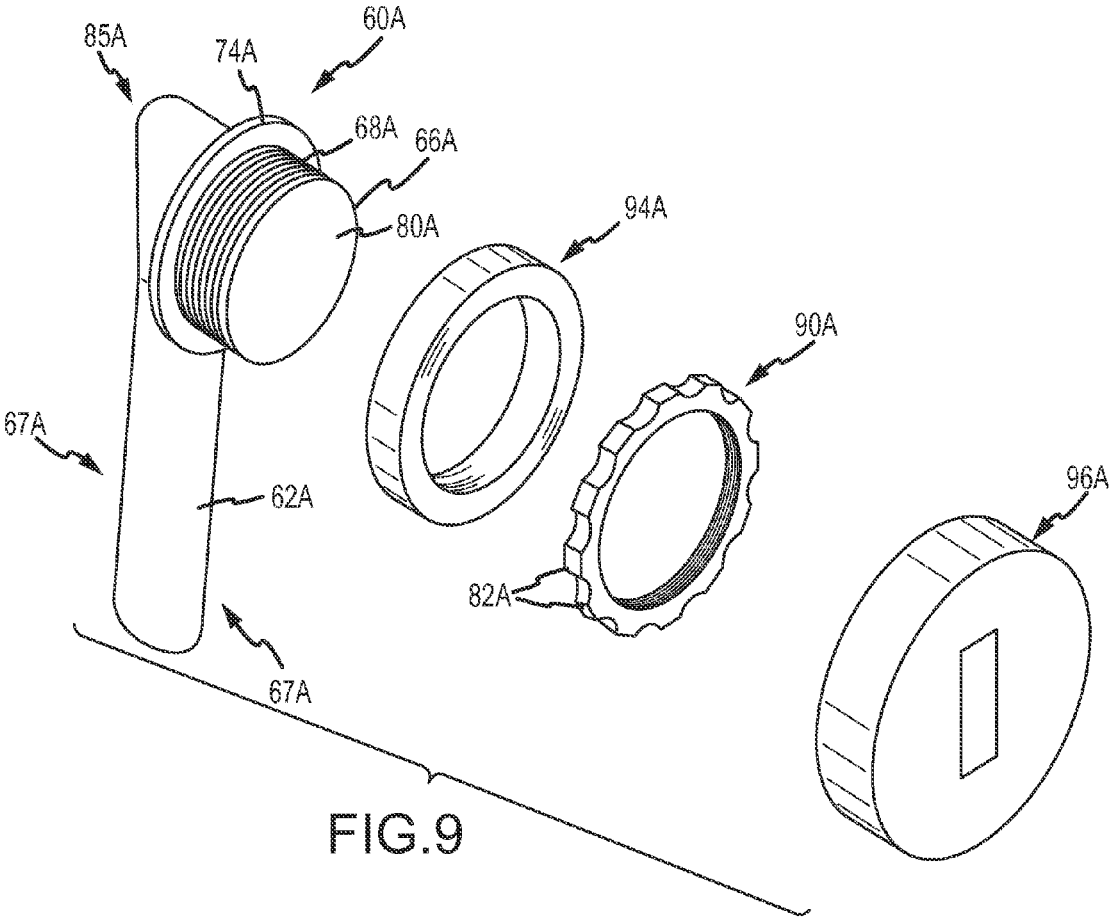
FIG. 9 is an exploded perspective view of the device of the embodiment of the invention shown in FIG. 6.

With reference to FIGS. 7-9, the overflow fitting 60A is shown that has an overflow pipe 62A with an inverted L-shape. The overflow pipe 62A has an elbow portion 65A which defines an upper end portion 66A and a lower end portion 67A. It will be understood that the overflow pipe 62A may be made of copper, plastic, or any other suitable material.

The upper end portion 66A has threads 68A on its outer surface and also has an outer end 70A. The outer end 70A defines an inlet 71A to the upper end portion 66A of the overflow pipe 62A. The inlet 71A is adapted to fit through the bathtub overflow port.

The overflow fitting 60A also has a lip 74A extending radially outwardly from an outer surface of the overflow pipe 62A between the elbow portion 65A and the upper end portion 66A. The lip 74A is spaced from the inlet 71A to engage an outer surface of the bathtub end wall 24 around the bathtub overflow port 30, thereby allowing only the upper end portion 66A to pass through the overflow port 30.

A thin diaphragm 80A is sealed to the outer end 70A of the end portion 66A. The diaphragm 80A is a circular membrane and has a diameter that is not less than the diameter of the outer end 70A of the overflow pipe 62A. In one embodiment, the diaphragm 80A is integral with the outer end 70A and is held to the outer end 70A only through having been integrally formed therewith. The diaphragm 80A may be hermetically sealed to the outer end 70A. The diaphragm 80A may be composed of plastic material, flexible rubber, or the like. The diaphragm 80A is composed of a material that is easily punctured or easily removable.

The overflow fitting 60A further includes a nut element 90A having threads compatible with the threads 68A on the upper end portion 66A of the overflow pipe 62A. The nut element 90A removably secures the overflow pipe 62A to the bathtub 20 by compressing the end wall 24 between the nut element 90A and the lip 74A. The nut element 90A may be a slip nut.

As shown in FIG. 9, the nut element 90A has a series of radially extending lugs 92A along the nut element 90A outer periphery. These lugs 92A detachably engage the inner surface of a cap 96A. The cap 96A serves to cover the overflow fitting 60A hardware.

During installation of the overflow fitting 60A, a washer 94A may be placed between the upper end portion 66A of the overflow pipe 62A and the nut element 90A. The washer 94A seals the overflow fitting 60A to the tub 18.

In operation, the drainage system comprising the ports 28 and 30, and pipes 34, 36, and 38 are installed as shown in FIG. 2. The vent pipe 40 and connecting pipe 42 are also installed.

Figure 5:
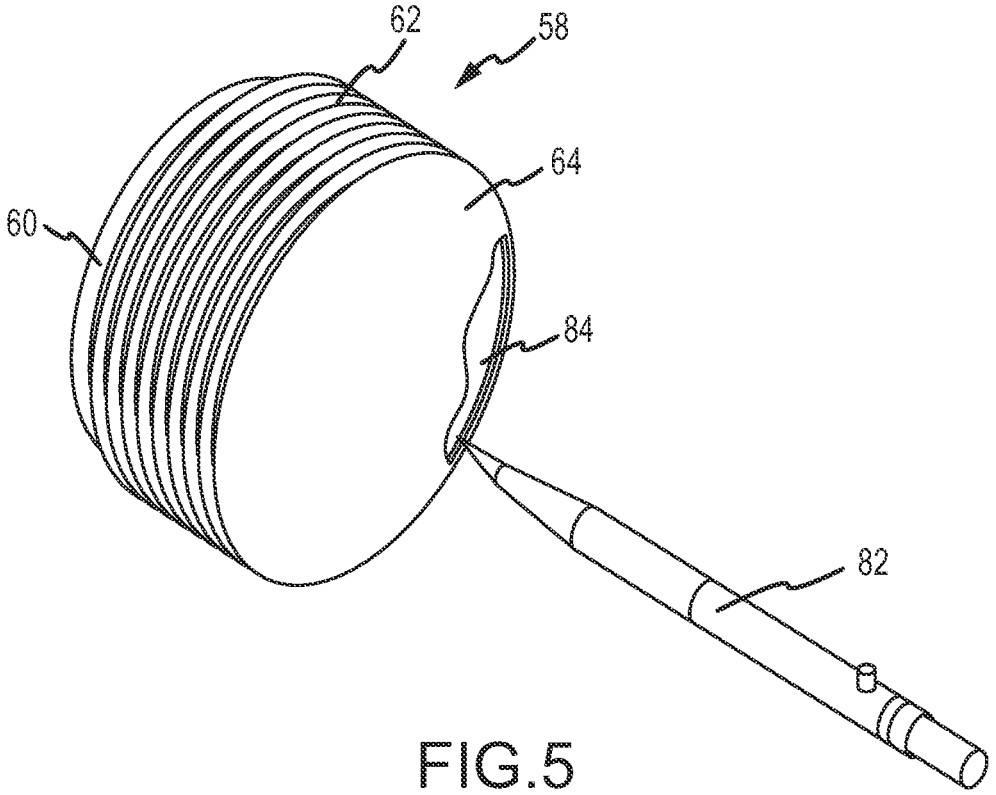
FIG. 5 is a perspective view showing a pierced diaphragm.

In the conventional testing procedure, the port 28 is plugged in any convenient manner. The fitting 58 with diaphragm 64 is installed into drain pipe 34 as described above so there is no fluid access to the upper end of pipe 34 either inwardly or outwardly through overflow port 30. The vent pipe 40 is charged with water at some elevation above connecting pipe 42 so that the building inspectors can check to see if there are any leaks in the system. Having determined that there are no leaks, the water is purged from the system. The plumber can then approach overflow port 30, (because cap 78 is not yet installed) and by using knife 82 or the like, cuts can be made in diaphragm 64 leaving a cutout portion 84 as shown in FIG. 5.

Similarly, in operation the overflow fitting 60A is attached to the second vertical drain pipe 34A already plugged by the diaphragm 80A as described above, so there is no fluid access to the upper end of second vertical drain pipe 34A either inwardly or outwardly out of the overflow port 30. The vertical vent pipe 40 is charged with water at some elevation above connecting pipe 42 so that it can be determined if there are any leaks in the system.

Figure 10:
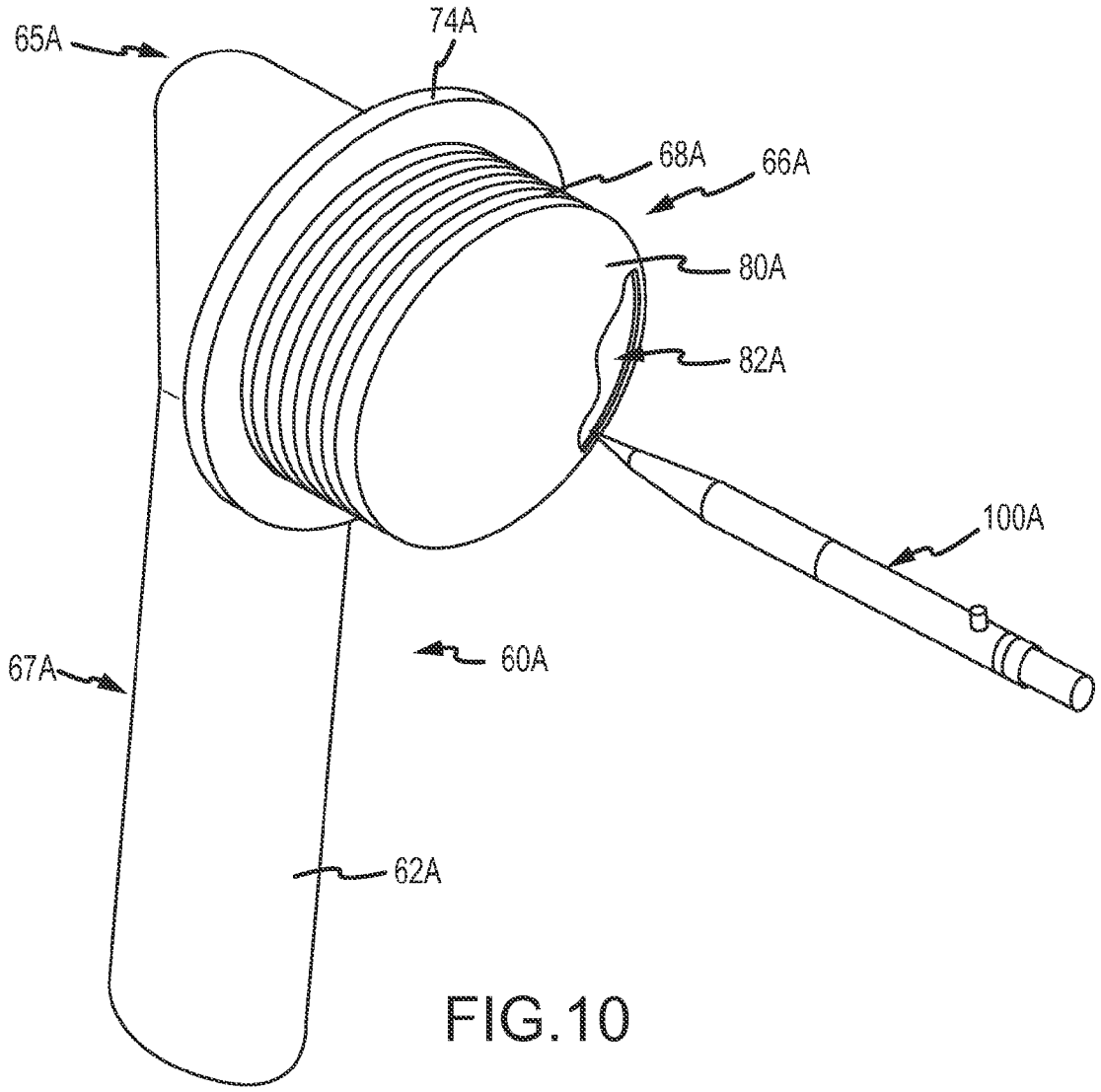
FIG. 10 is a perspective view of the installation of the embodiment of the invention shown in FIG. 6.

With reference to FIG. 10, having determined that there are no leaks, the water is purged from the system. The plumber can then approach overflow port 30, and by using a cutting device 100A, such as a knife of any other sharp object, cuts 82A can be made in the diaphragm 80A. This can be quickly and easily done without disassembling any of the structure of overflow fitting 60A. Any valve linkage elements required may be installed through cuts 82A, and any cap (such as cap 96A shown in FIG. 9) or cover for the overflow port 30 may be placed over the overflow pipe 62A upper end portion 66A.

Figure 11:
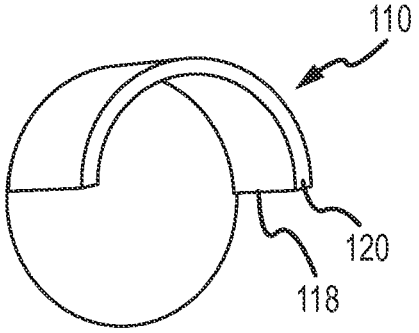
FIG. 11 is a perspective view of an overflow plate according to one embodiment of the present invention.
Figure 12:
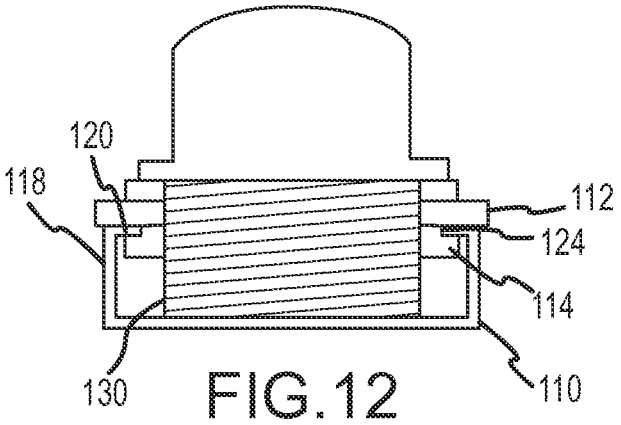
FIG. 12 is a sectional top view of the assembly according to one embodiment of the present invention.

Referring now to FIGS. 11 and 12, an alternate embodiment of the invention is shown wherein an overflow plate 110 is modified to slide vertically into position between the surface of the tub 112 and the retainer nut 114. The overflow plate 110 has a first section, which comprises a rim 118 and a lip 120 extending inwardly therefrom, and a second section, which does not comprise a rim or a lip, thereby forming a recessed portion. The modified overflow plate 110 engages a notched surface 124 on at least a portion of the retainer nut 114 as shown in FIG. 12. The notch 124 may be incorporated along the entire circumference of the nut 114 as well. The overflow plate 110 according to this embodiment slides along an outward facing surface of the overflow plate 130 and engages the retainer nut 114 along the notched surface 124. The notched surface 124 is located along a lateral face of the retainer nut 114. The thickness of the lip 120 and the width of the notched surface 124 are such that the overflow plate 110 forms a near perfect fit once it engages the notched surface 124, thereby firmly holding the overflow plate 110 in place between the retainer nut 114 and the surface of the tub 112.

Figure 13:
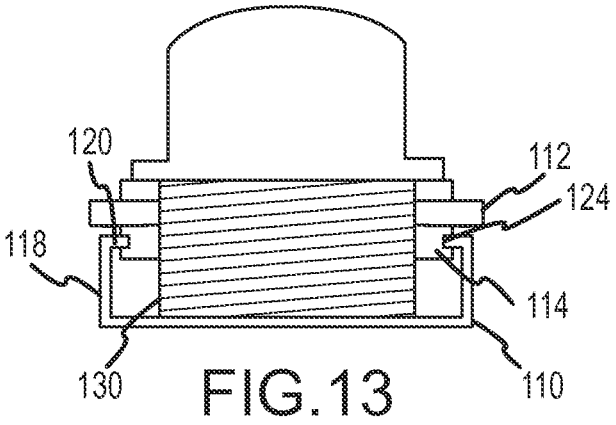
FIG. 13 is a sectional top view of the assembly according to another embodiment of the present invention.

As shown in FIG. 13, the notched surface 124 of the retainer nut 114 may be located nearly concentrically about the thickness of the retainer nut 114. According to this embodiment, the overflow plate 110 may be engaged with the centrally located notched surface 124 of the retainer nut 114, by sliding the overflow plate 110 in a downward direction to engage the lip 120 of the overflow plate 110. According to this embodiment, the overflow plate 110 is held in place by engaging both sides of the retainer nut 114 surrounding the notched surface 124, thereby holding the overflow plate 110 firmly in place over the overflow port 130.

Figure 14A:
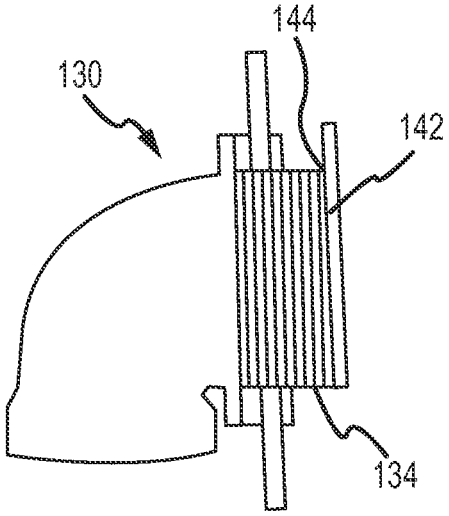
FIG. 14*a* is a sectional side view of the assembly according to yet another embodiment of the present invention.
Figure 14B:
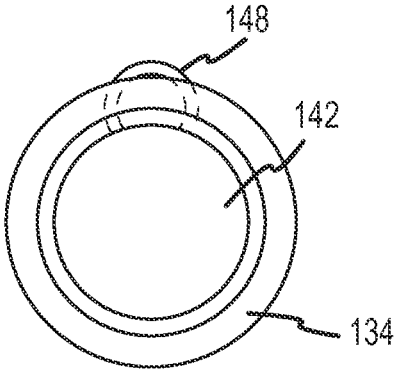
FIG. 14*b* is a partial front view of the assembly of FIG. 14*a;*
Figure 15:
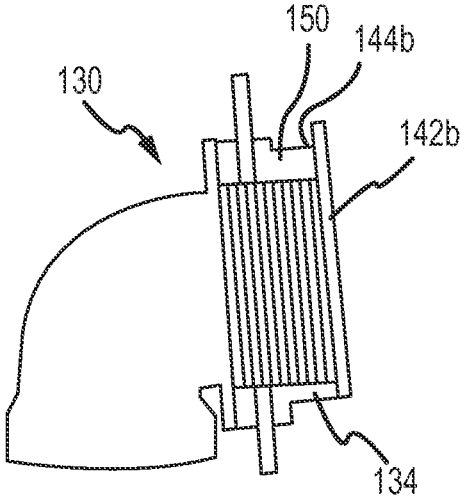
FIG. 15 is a sectional side view of the assembly according to yet another embodiment of the present invention.

Further alternative embodiments are shown in FIGS. 14*a*, 14*b* and 15, that show a removable seal 142 that may be selectively inserted or removed from the overflow assembly to prevent or permit water to flow through the overflow assembly 130. The removable seal 142, according to this embodiment, is such that it may be inserted into a slot 144 formed in the threaded portion 134 of the overflow assembly 130, thereby sealing the overflow valve 130, or removed from the slot 144, thereby exposing the overflow port 130 without requiring a knife or other tool to cut out the seal 142 and potentially requiring the plumber to replace the seal 142 at a later time.

Referring now in detail to FIGS. 14*a* and 14*b*, according to one embodiment the seal 142 is inserted into a slot 144 formed within the threaded portion 134 of the overflow valve 130, such that the seal 142 resides in a vertical plane within the threaded portion 134 of the overflow assembly 130. The diameter seal 142 is substantially congruent with the diameter of the threaded portion 134 of the threaded portion 134 overflow valve 130, as best shown in FIG. 14*b*. The seal 142 may have a pull ring 148, which extends outside the slot 144 formed in the threaded portion 134 of the overflow assembly 130 so that the plumber may readily grasp the pull ring 148 and remove the seal 142 from the slot 144 in the threaded portion 134 of the overflow valve.

In yet another embodiment, the seal 142*b* is formed in a slot 144*b* that is formed in the retainer nut 150, which may be modified to extend outwardly from the outer most surface of the threaded portion 134 overflow assembly 130, as shown in FIG. 15. The seal 142*b* according to this embodiment operates in the same fashion is that described in relation between FIGS. 14*a* and 14*b*, in that the seal 142*b* may be removed or inserted at the discretion of the user.

It is therefore seen from the description above and accompanying drawing figures that this invention eliminates any need to seal the overflow pipe 34, 60A even after the overflow pipe 60A has been attached to the second vertical drain pipe 34A. The invention also eliminates any need to remove sealing components from the overflow port 30 after the testing procedure has taken place. In addition, the invention allows a user to install an overflow fitting 58, 62A without using solvent cement. This invention also facilitates the testing procedure and reduces the time needed to seal the overflow port 30, and then to open the diaphragm 64, 80A for possible fluid flow.

Figure 16:
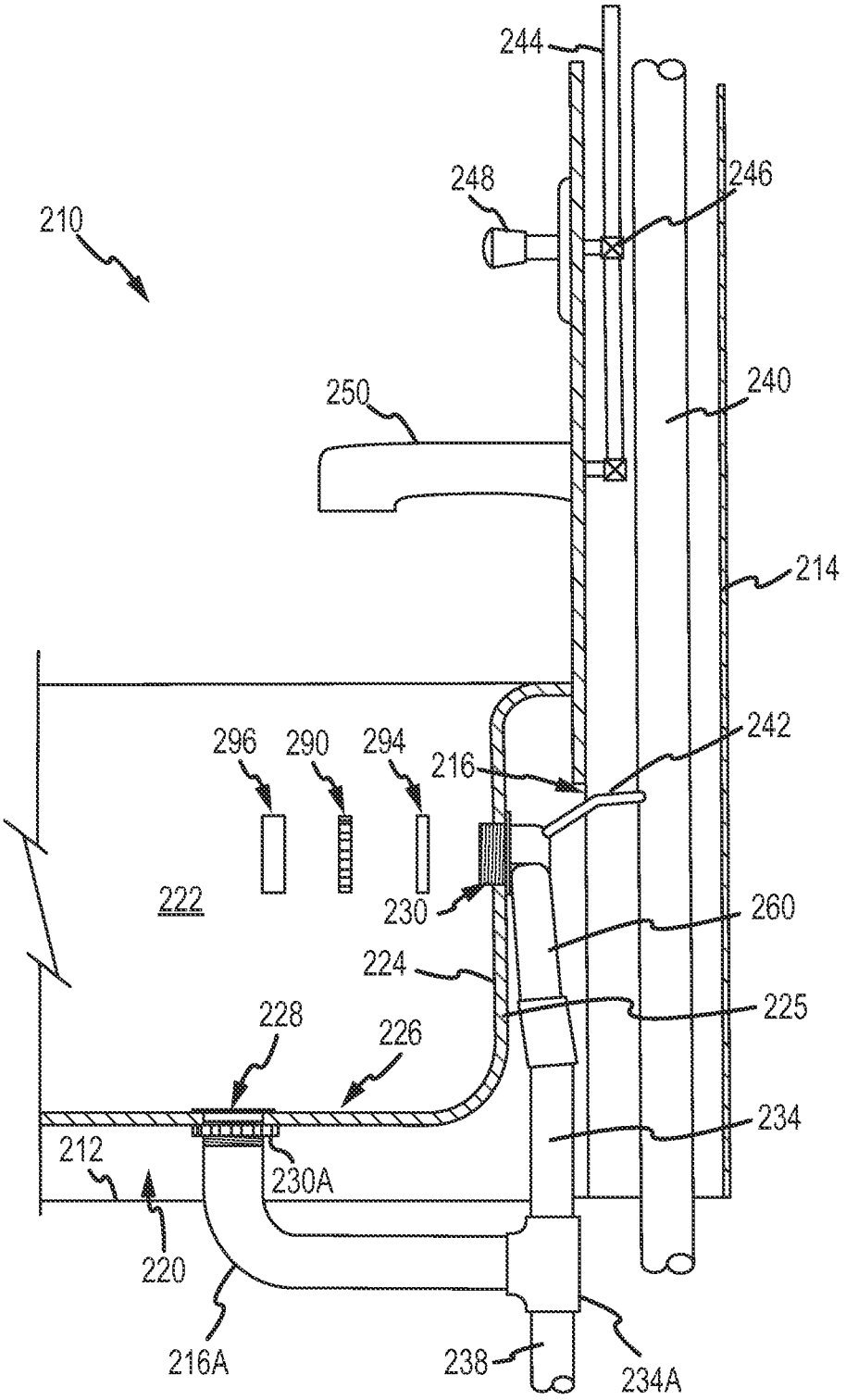
FIG. 16 is a sectional side view of a conventional bathtub environment utilizing the device of this invention.

With reference to FIG. 16, a conventional bathroom structure 210 has a floor 212, and a hollow wall 214 with a wall opening 216 therein. A conventional bathtub (hereinafter "bathtub") 220 rests upon floor 212.

The tub 220 has side walls 222, end walls 224, and a bottom 226. The side walls 222 extend upwardly from the bottom 226. The end walls 224 extend upwardly from the bottom 26, perpendicular to the side walls 222, and have an outer surface 225.

A drain port 228 is located in the bottom 226. A conventional overflow port 230 is located in the end wall 224. A drain pipe 16A extends downwardly from drain port 228. A second vertical drain pipe 34 extends downwardly from the overflow port 230. The drain pipe 216A connects drain port 28 and drain system 234A. A primary drain pipe 38 extends downwardly from the drain system 234A, seen in FIG. 16 as a T-shaped elbow.

A conventional vertical vent pipe 240 is located within the hollow wall 214. A connector vent pipe 242 is in fluid flow communication with the vent pipe 240 and the upper end of the second vertical drain pipe 234.

Conventional water pipes 244 extend through hollow wall 214 and are connected to a valve 246. The valve 246 is interconnected with conventional control members 248 and faucet 250. A one-piece overflow fitting 260 is attached to the second vertical drain pipe 234, and a portion of the overflow fitting 260 passes through overflow port 230.

Figure 17:
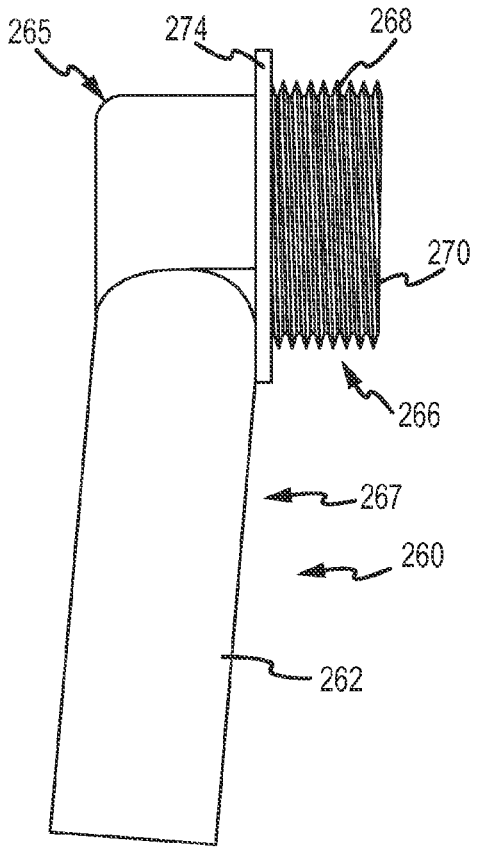
FIG. 17 is a side view of the device of one embodiment this invention.
Figure 18:
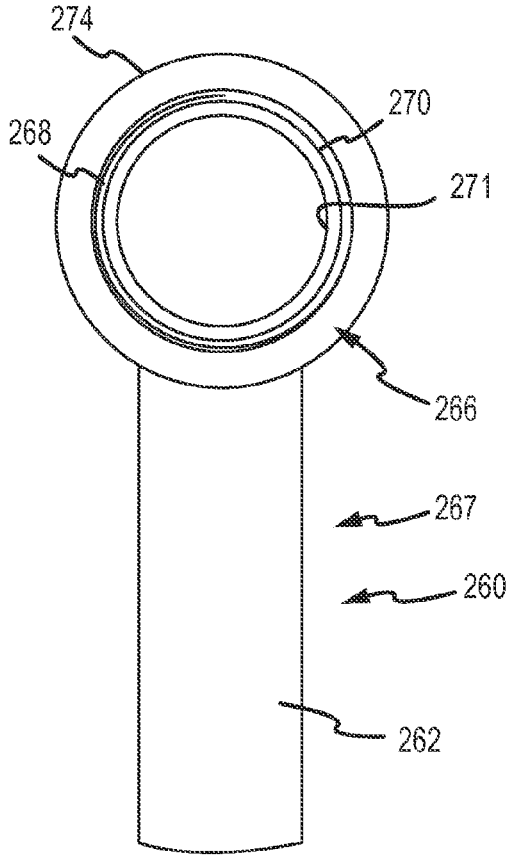
FIG. 18 is a front view of the device of one embodiment this invention.
Figure 19:
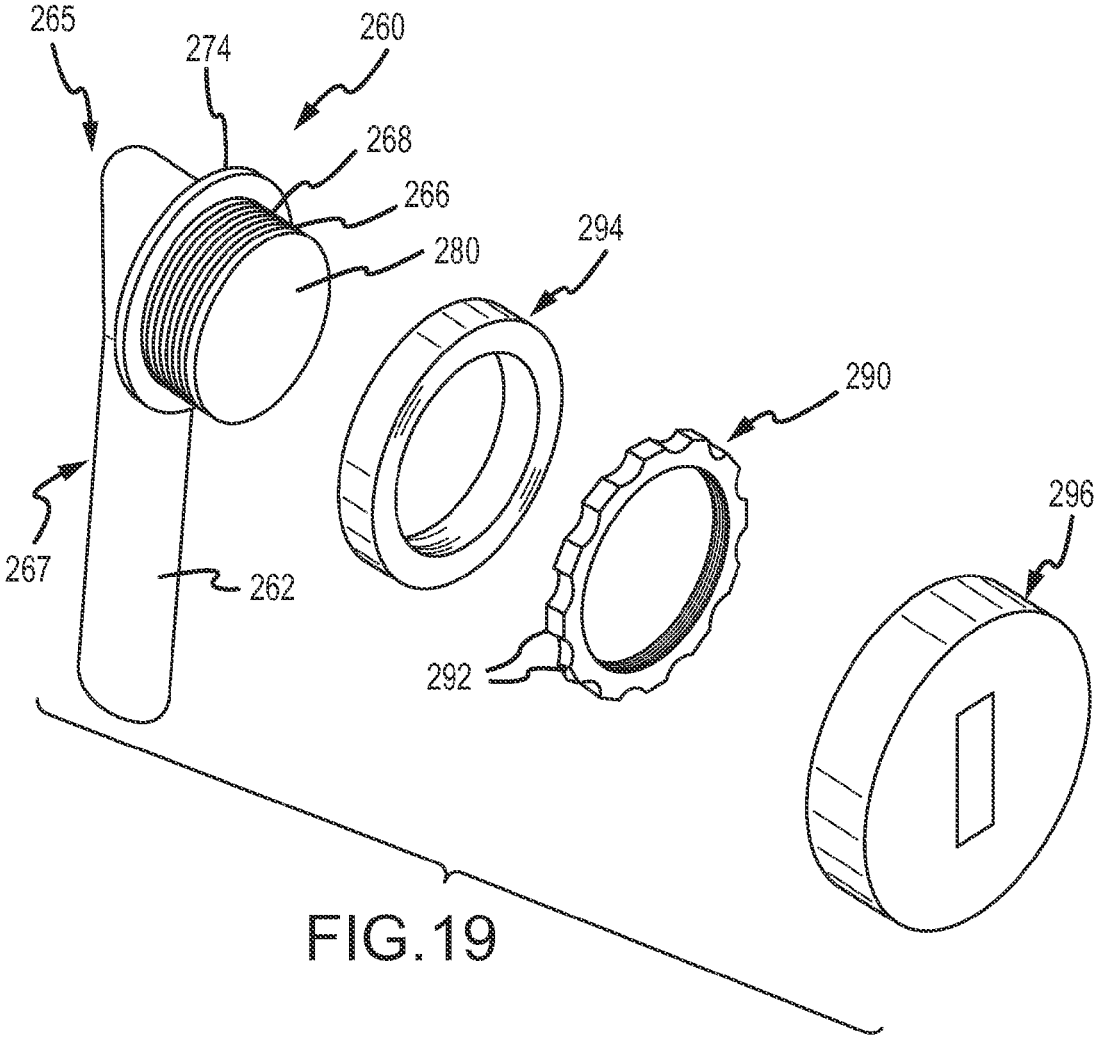
FIG. 19 is an exploded perspective view of the device of one embodiment this invention.

With reference to FIGS. 17-19, the overflow fitting 260 has an overflow pipe 262 with an inverted L-shape. The overflow pipe 262 has an elbow portion 265 which defines an upper end portion 266 and a lower end portion 267. It will be understood that the overflow pipe 262 may be made of copper, plastic, or any other suitable material.

The upper end portion 266 has threads 268 on its outer surface and also has an outer end 270. The outer end 270 defines an inlet 271 to the upper end portion 266 of the overflow pipe 262. The inlet 271 is adapted to fit through the bathtub overflow port 230.

The overflow fitting 260 also has a lip 274 extending radially outwardly from an outer surface of the overflow pipe 262 between the elbow portion 265 and the upper end portion 266. The lip 274 is spaced from the inlet 271 to engage an outer surface 225 of the bathtub end wall 224 around the bathtub overflow port 230, thereby allowing only the upper end portion 66 to pass through the overflow port 230.

A thin diaphragm 280 is sealed to the outer end 270 of the end portion 266. The diaphragm 280 is a circular membrane and has a diameter that is not less than the diameter of the outer end 270 of the overflow pipe 262. In one embodiment, the diaphragm 280 is integral with the outer end 270 and is held to the outer end 270 only through having been integrally formed therewith. The diaphragm 280 may be hermetically sealed to the outer end 270. The diaphragm 280 may be composed of plastic material, flexible rubber, or the like. The diaphragm 280 is composed of a material that is easily punctured or easily removable.

Referring to FIGS. 16 and 19, the overflow pipe fitting 260 further includes, a nut element 290 having threads compatible with the threads 268 on the upper end portion 266 of the overflow pipe 262. The nut element 290 removably secures the overflow pipe 262 to the bathtub 220 by compressing the end wall 24 between the nut element 290 and the lip 274. The nut element 290 may be a slip nut.

As shown in FIG. 19, the nut element 290 has a series of radially extending lugs 292 along the nut 290 outer periphery to constitute a single-piece unit. These lugs 292 detachably engage the inner surface of a cap 296. The cap 296 serves to cover the overflow pipe fitting 260 hardware. The cap 296 of one embodiment of the present invention includes a surface, which is bounded by a sidewall, that is positioned within the bathtub.

During installation of the overflow pipe fitting 260, a washer 294 may be placed between the upper end portion 266 of the overflow pipe 262 and the nut element 290. The washer 294 seals the overflow pipe fitting 260 to the tub 220.

Figure 21:
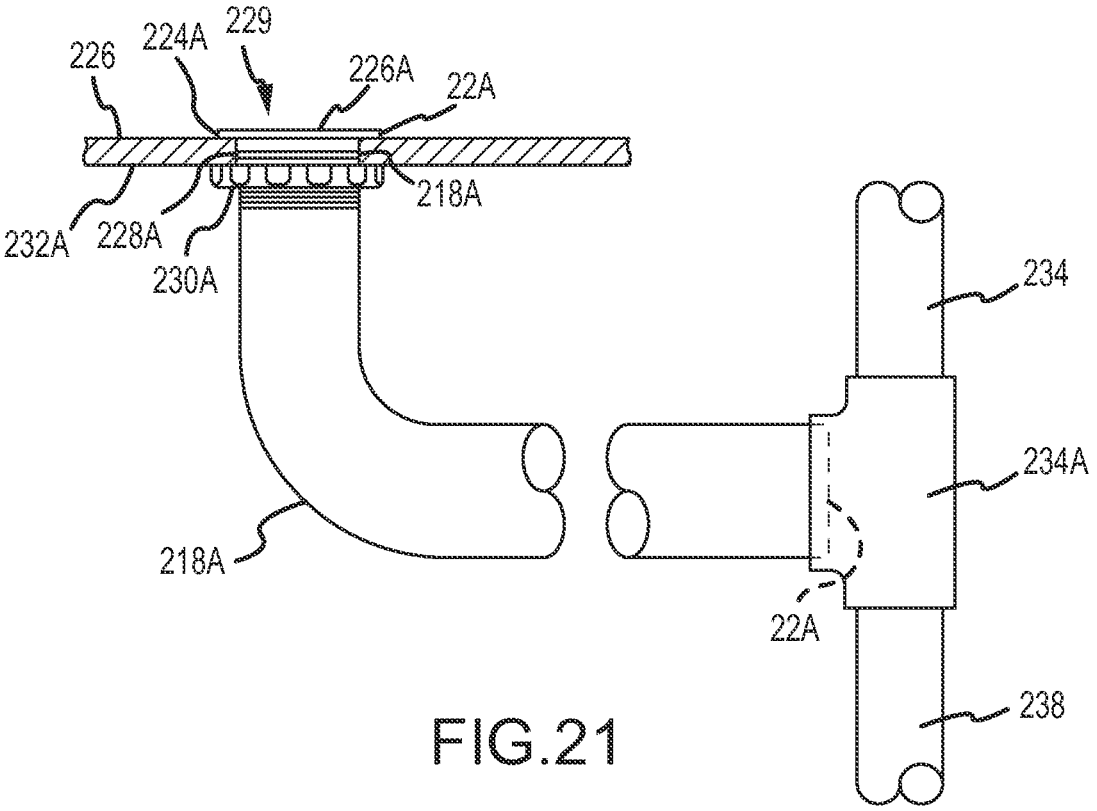
FIG. 21 is a side view of the installed drain assembly.
Figure 22:
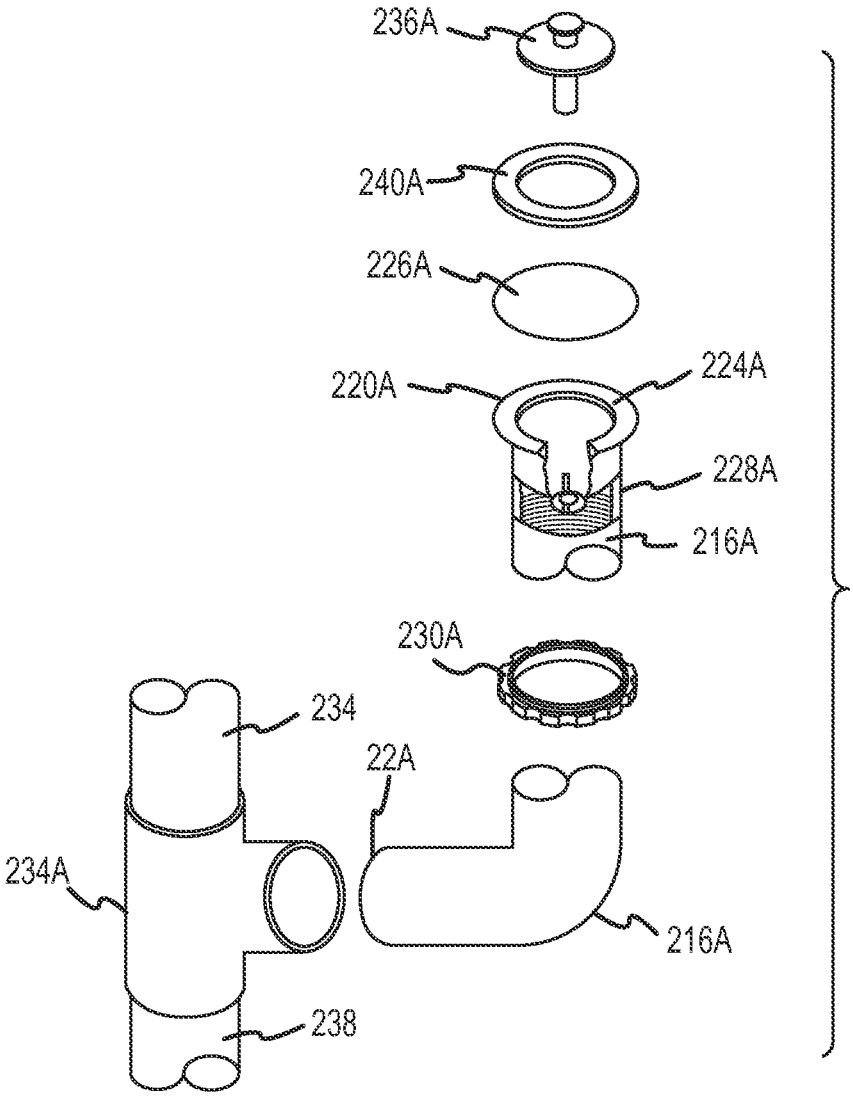
FIG. 22 is an exploded perspective view of the drain assembly.

Referring to FIG. 21, when installing the waste water drain 229, the method begins by inserting a generally L-shaped drain pipe 216A through a drain hole 218A on the bottom wall 226 of the bathtub 220. The drain pipe 216A has both an upper end 220A and an inner end 222A. The upper end terminates in an annular flange 224A and in one embodiment is covered by a membrane 226A. Membrane 226A in one embodiment is a flat planar membrane of continuous construction that dwells in a single plane. Also, near the upper end 220A of the drain pipe 216A is a threaded portion 228A. The drain pipe 216A is inserted into the drain hole 18A, such that the annular flange 224A rests on the bottom wall 226 of the bathtub 210. A sealant material is placed on a lower surface of the annular flange 224A for securing the annual flange to the bottom wall 226 of the bathtub 220.

Next, a lock washer 230A is slidably mounted over the inner end 222A of the drain pipe 216A until it reaches the threaded portion 228A near the upper end 220A of the drain pipe 216A. There, lock washer 230A, which is threadably received on the threaded portion 228A, is tightened against the lower surface 232A of the bottom wall 226 of the bathtub 220.

Once the lock washer 230A is tightened, the inner end 222A of the drain pipe 216A is connected to a T-shaped elbow 234A. Once connected, the drain assembly and drain system are tested for water leaks. When it is determined that there are no leaks, the membrane 226A is removed from the flange 224A on the upper end 220A of the drain pipe 216A.

Once the drain closure 236A is installed, a cover 240A can be placed on the flange 224A of the upper end 220A of the drain pipe 216A. In the preferred embodiment, the cover 240A frictionally engages the flange 224A.

Then, a drain closure 236A is installed into the upper end 220A of the drain pipe 216A. The drain closure 236A can be of any conventional type, including lift and turn, foot actuated, or PUSH-PULL™ closures. Likewise, a PRES-FLO™ drain closure such as the one described in U.S. Pat. No. 4,457,030 by Burry can be installed. Crossbars can be snapped into the upper end 220A of the drain pipe 216A to assist in securing the drain closure 236A depending upon the type of drain closure used. The ability to snap in the crossbars minimizes the difficulty in repairing stripped out threads used in some conventional drain closures.

Because the drain assembly is installed with new construction where the tub is in place and there is no drywall on the open interior wall 214, a single individual is capable of holding the drain pipe 216A in place while the lock washer is slidably mounted on the drain pipe and tightened on the threaded portion 228A, thus eliminating the need for multiple individuals for installation.

In operation, the drainage system, T-shaped elbow 234A; the ports 228 and 230; pipes 234, 238; and the overflow pipe fitting 260 are installed as shown in FIG. 16. Vertical vent pipe 240 and connector vent pipe 242 are also installed.

In the testing procedure, the port 228 is plugged in any conventional manner. The overflow pipe fitting 260 is attached to the second vertical drain pipe 234 already plugged by the diaphragm 280 as described above, so there is no fluid access to the upper end of pipe 234 either inwardly or outwardly out of the overflow port 230. The vertical vent pipe 240 is charged with water at some elevation above pipe 242 so that it can be determined if there are any leaks in the system.

Figure 20:
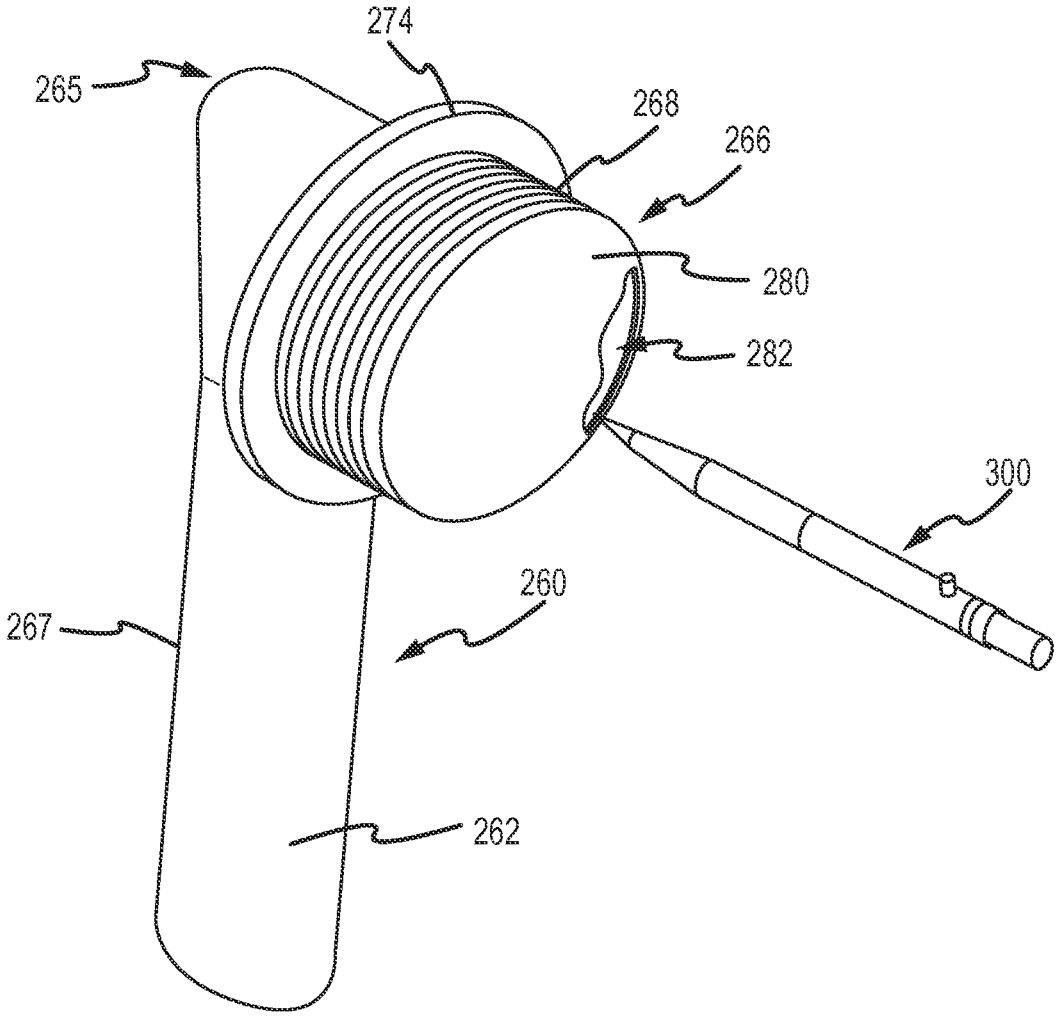
FIG. 20 is a perspective view of the installation of the device of one embodiment this invention.

With reference to FIG. 20, having determined that there are no leaks, the water is purged from the system. The plumber can then approach overflow port 230, and by using a cutting device 300, such as a knife of any other sharp object, cuts 282 can be made in the diaphragm 280. This can be quickly and easily done without disassembling any of the structure of overflow pipe fitting 260. Any valve linkage elements required may be installed through cuts 282, and any cap or cover for the overflow port 230 may be placed over the overflow pipe 262 end portion 266.

Furthermore, during testing this invention eliminates any need to seal shut the overflow pipe 262 after the pipe 262 has been attached to the second vertical drain pipe 234. The invention also eliminates any need to remove sealing components from the overflow port 230 after the testing procedure has taken place. In addition, the invention allows a user to install the overflow fitting 260 without using solvent cement.

Figure 23:
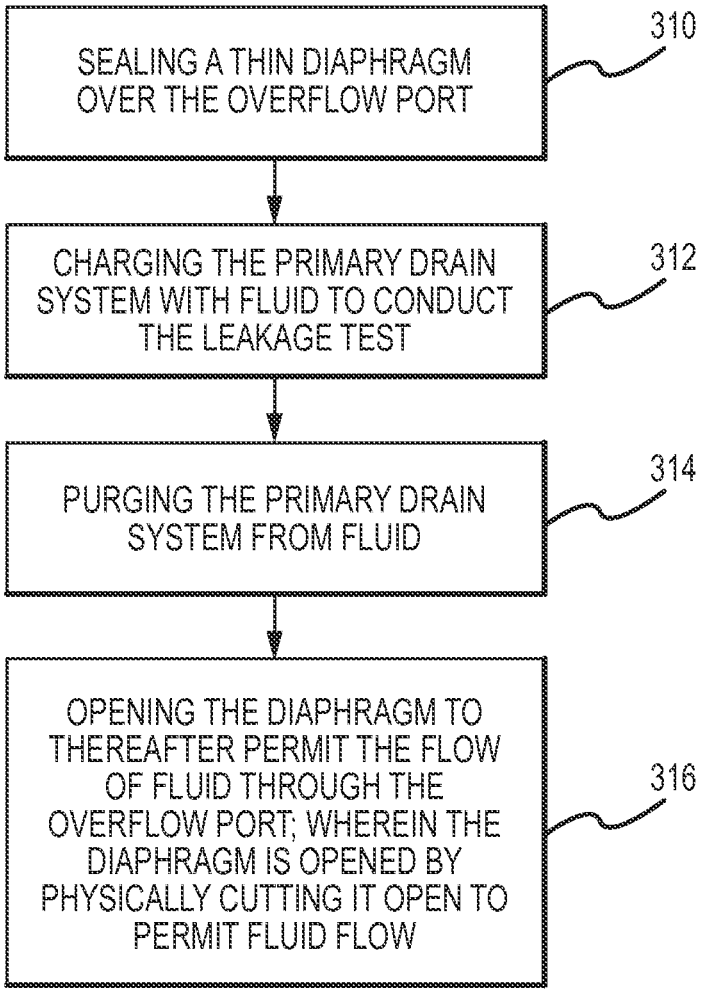
FIG. 23 is a flow chart of a method for conducting a fluid leak test on a fluid system.

FIG. 23 shows a flow chart of a method for conducting a fluid leak test on a fluid system comprising a bathtub 220 which has a bottom 226 and adjacent and end wall 224, and an overflow port 230 in an end wall 224 with the bottom 226 having a waste water drain 229, and with the overflow port 230 and the waste water drain 229 being in communication with a primary drain system 234A. The steps comprise sealing a diaphragm 280, 226A over the overflow port 230 and the waste water drain 229 as shown in box 310. Then, charging the primary drain system 234A with fluid to conduct the leakage test as shown in box 312. The next step involves purging the primary drain system 234A of fluid, as shown in box 314. The step shown in box 316 involves opening the diaphragms 226A to thereafter permit the flow of fluid through the overflow port 230. The final step is wherein the diaphragm 226A is opened by physically cutting it open to permit fluid flow as shown in box 318.

This method can also include wherein the waste water drain 229 is connected to the primary drain system 234A by providing a generally L-shaped drain pipe 216A having a hollow upstanding portion with an open upper end 220A and a horizontal portion with an open inner end 227A with the upstanding horizontal portion being connected by an L-shaped portion. This method includes placing a horizontal flange 224A around the upper end 20A of the upstanding portion. The next step is providing external threads 228A on the outside surface of the upstanding portion; inserting the open inner end 222A of the horizontal portion downwardly through a drain opening 218A in a tub 220 which has a diameter greater than a diameter of the upstanding portion but less than a diameter of the flange so that the flange engages a portion of the bathtub around the drain opening. Then, the method includes inserting a threaded lock washer 230A with an internally threaded center bore over the inner end 222A of the horizontal portion wherein the center bore of the lock washer 230A has a diameter greater than an outside diameter of the horizontal portion, the L-shaped portion and the upstanding portion. Another step involves sliding the lock washer 230A over the L-shaped drain pipe 216A until it engages the external threads on the upstanding portion and tightening the lock washer 230A against a portion of the tub around and underneath the drain opening 218A in the tub to seal the flange 224A tightly against the tub around the drain opening 218A.

Finally, the method is completed by connecting the open inner end 222A of the horizontal portion to the waste water drain pipe 216A.

As can be seen from the foregoing disclosure, the present invention provides an easy method of installing a drain assembly for a bathtub by a single individual that makes it easier to test for leaks, easier to replace the finished materials without requiring the removal of the strainer body, and reduces the amount of material that requires special finishing.

What is claimed is:

1. An overflow assembly adapted for interconnection to a bathtub, which has a bottom, side walls, end walls, an overflow port in one end wall, and a pipe with an elbow portion defining an upper end portion and a lower end portion, the upper end portion having an outer end defining an inlet, the upper end portion having threads on an outer surface thereof, the pipe including a lip extending radially outwardly from the outer surface of the overflow pipe between the elbow portion and the upper end portion and being spaced from the inlet, the improvement comprising:

a nut element with a threaded portion that is compatible with the threads of the overflow pipe, the nut element having an outer periphery that is adapted to detachably engage an inner surface of a cap that fits over the nut.

2. The overflow assembly of claim 1, wherein the nut element is comprised of a first portion that includes the outer periphery that is adapted to selectively engage the cap, and a second portion that extends from the first portion, the second portion having a portion that has an outermost dimension that is less than a maximum outer dimension of the outer periphery.

3. The overflow assembly of claim 1, wherein the nut element is comprised of a first portion that includes the outer surface, which includes the outer periphery, and a second portion that extends from the first portion, the second portion having a portion that has an outermost dimension that is less than that of the outer periphery.

* * * * *